US009057987B2

(12) United States Patent
Oda

(10) Patent No.: US 9,057,987 B2
(45) Date of Patent: Jun. 16, 2015

(54) IMAGE FORMING APPARATUS

(75) Inventor: Yasuhiro Oda, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 170 days.

(21) Appl. No.: 13/595,674

(22) Filed: Aug. 27, 2012

(65) Prior Publication Data

US 2013/0251413 A1 Sep. 26, 2013

(30) Foreign Application Priority Data

Mar. 23, 2012 (JP) ..... 2012-067541

(51) Int. Cl.

| | |
|---|---|
| ***G03G 15/09*** | (2006.01) |
| *G03G 5/05* | (2006.01) |
| *G03G 5/06* | (2006.01) |
| *G03G 5/07* | (2006.01) |
| *G03G 5/147* | (2006.01) |

(52) U.S. Cl.

CPC ..... *G03G 15/0921* (2013.01); *G03G 15/09* (2013.01); *G03G 2215/00957* (2013.01); *G03G 2215/0648* (2013.01); *G03G 5/0592* (2013.01); *G03G 5/0614* (2013.01); *G03G 5/075* (2013.01); *G03G 5/076* (2013.01); *G03G 5/14791* (2013.01); *G03G 5/14795* (2013.01)

(58) Field of Classification Search

CPC ..... G03G 15/0921; G03G 2215/0648
USPC ..... 399/269
See application file for complete search history.

(56) References Cited

U.S. PATENT DOCUMENTS

| | | | | |
|---|---|---|---|---|
| 4,679,527 | A * | 7/1987 | Chang | 399/269 |
| 4,766,048 | A * | 8/1988 | Hisamura | 430/58.05 |
| 5,527,658 | A * | 6/1996 | Hopper et al. | 430/137.14 |
| 5,640,648 | A * | 6/1997 | Komakine et al. | 399/103 |
| 5,923,933 | A | 7/1999 | Anzai et al. | |
| 6,813,462 | B2 * | 11/2004 | Mitsuya et al. | 399/269 |
| 2002/0044797 | A1 * | 4/2002 | Itoh | 399/269 |
| 2004/0013442 | A1 * | 1/2004 | Suzuki et al. | 399/92 |
| 2007/0212123 | A1 * | 9/2007 | Kabashima | 399/269 |
| 2009/0238602 | A1 | 9/2009 | Iwasaki et al. | |
| 2010/0316944 | A1 | 12/2010 | Nakajima et al. | |

FOREIGN PATENT DOCUMENTS

| | | | |
|---|---|---|---|
| JP | 7-128878 | A | 5/1995 |
| JP | 3227978 | B2 | 11/2001 |
| JP | 3239259 | B2 | 12/2001 |
| JP | 3410941 | B2 | 5/2003 |
| JP | 2003-316057 | A | 11/2003 |

(Continued)

*Primary Examiner* — Benjamin Schmitt
(74) *Attorney, Agent, or Firm* — Sughrue Mion, PLLC

(57) ABSTRACT

An image forming apparatus includes a rotatable photoconductor and a developing device that uses a developer that exhibits magnetism, the developing device including a housing having an opening for development at a position facing the photoconductor, and plural developing rollers that are exposed through the opening in the housing, that rotate without contacting a surface of the photoconductor, and that are arranged without contacting each other in a direction in which the surface of the photoconductor rotates, wherein a minimum distance between an inner surface portion extending to the opening of the housing of the developing device and one of the developing rollers arranged close to the inner surface portion and a minimum distance between the housing and the surface of the photoconductor are each equal to or larger than a minimum distance between the developing rollers.

3 Claims, 17 Drawing Sheets

(56) References Cited

FOREIGN PATENT DOCUMENTS

| | | | |
|---|---|---|---|
| JP | 3763328 | B2 | 4/2006 |
| JP | 3915892 | B2 | 5/2007 |
| JP | 4042085 | B2 | 2/2008 |
| JP | 2009-229549 | A | 10/2009 |
| JP | 2010-286610 | A | 12/2010 |

* cited by examiner

IMAGE FORMING APPARATUS

CROSS-REFERENCE TO RELATED APPLICATIONS

This application is based on and claims priority under 35 USC 119 from Japanese Patent Application No. 2012-067541 filed Mar. 23, 2012.

BACKGROUND (i) Technical Field

The present invention relates to an image forming apparatus.

(ii) Related Art

An image forming apparatus, such as a printer, a copying machine, or a facsimile machine, to which an image recording system such as an electrophotographic system or an electrostatic recording system is applied includes a developing device that develops an electrostatic latent image formed on a photoconductor with a developer.

SUMMARY

According to an aspect of the invention, there is provided an image forming apparatus including a rotatable photoconductor including a top surface layer having a cross-linked structure formed by dehydration condensation of a charge-transporting monomer having a hydroxyl group; and a developing device that uses a developer that exhibits magnetism, the developer containing a toner obtained by dispersing fine particles that form the toner in a solvent containing water, causing aggregation, and conducting heating, the developing device including a housing having an opening for development at a position facing the photoconductor, and plural developing rollers that are exposed through the opening in the housing, that rotate without contacting a surface of the photoconductor, and that are arranged without contacting each other in a direction in which the surface of the photoconductor rotates, wherein a minimum distance between an inner surface portion extending to the opening of the housing of the developing device and one of the developing rollers arranged close to the inner surface portion and a minimum distance between the housing and the surface of the photoconductor are each equal to or larger than a minimum distance between the developing rollers.

BRIEF DESCRIPTION OF THE DRAWINGS

Exemplary embodiments of the present invention will be described in detail based on the following figures, wherein.

DETAILED DESCRIPTION

Exemplary embodiments for carrying out the invention (hereinafter referred to as "exemplary embodiments") will now be described with reference to the attached drawings.

First Exemplary Embodiment

Figure 1:
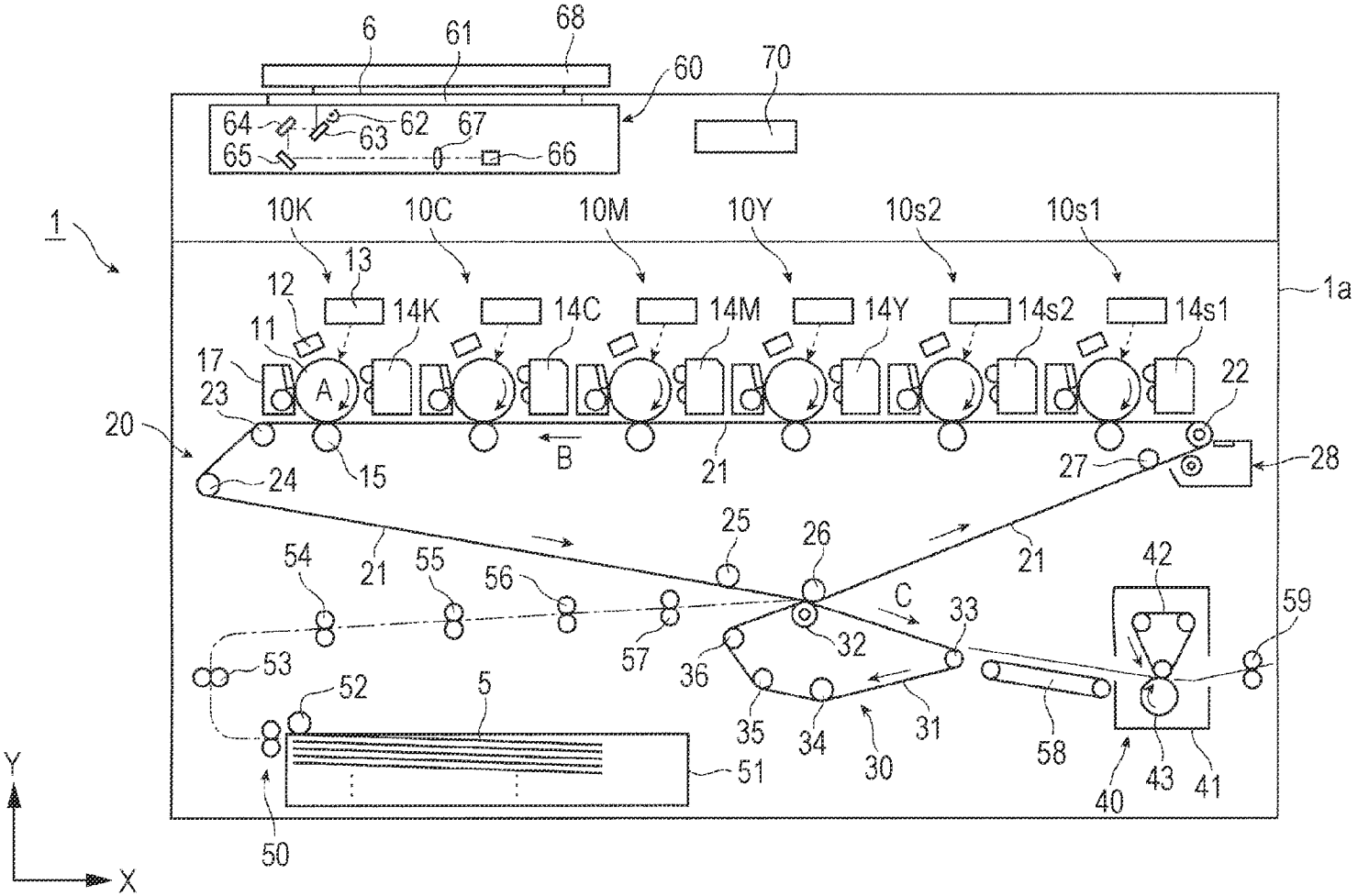
FIG. 1 is a schematic view illustrating an overall structure of an image forming apparatus according to a first exemplary embodiment etc.
Figure 2:
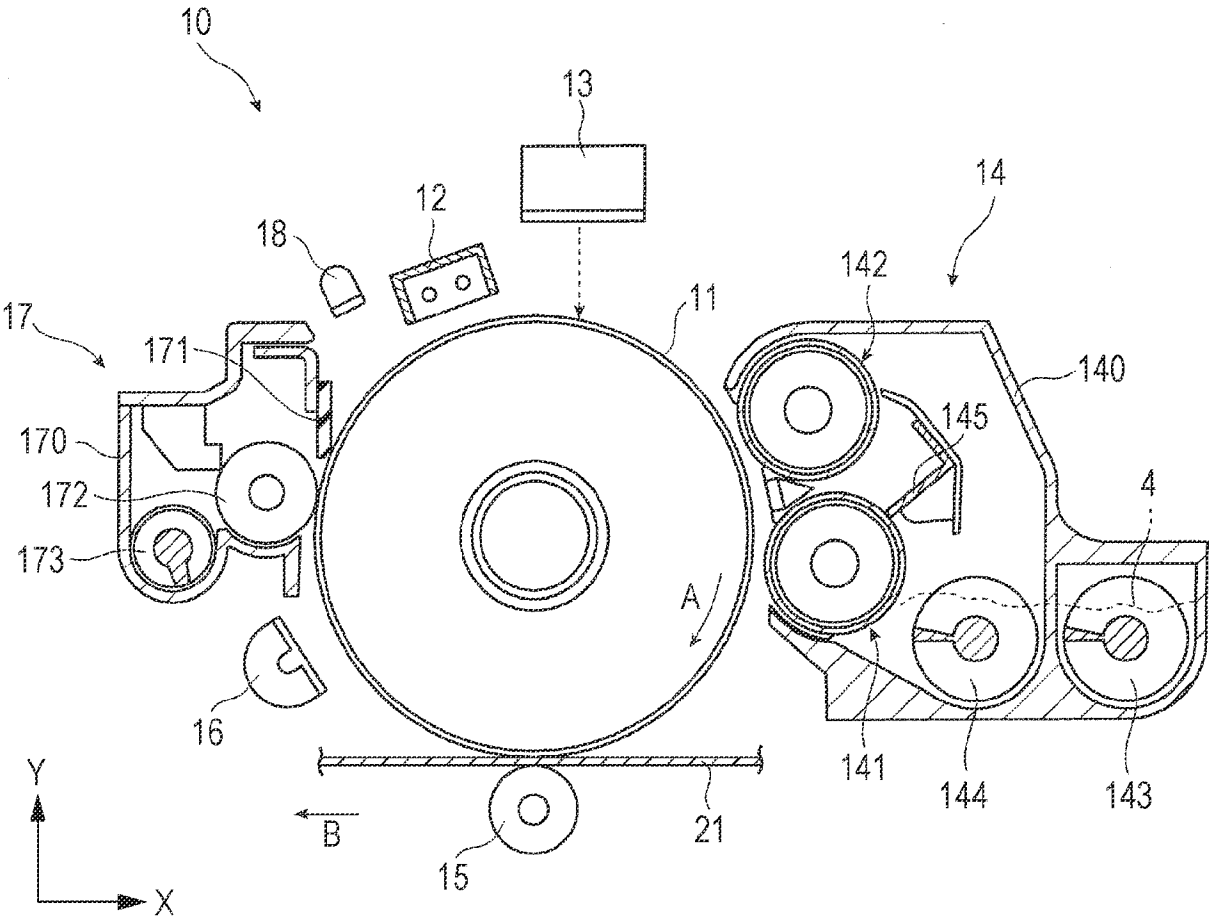
FIG. 2 is an enlarged view illustrating the relevant part (including an imaging device etc.) of the image forming apparatus illustrated in FIG. 1.

FIGS. 1 and 2 each illustrate an image forming apparatus according to a first exemplary embodiment. FIG. 1 is a view illustrating an overall structure of the image forming apparatus, and FIG. 2 is an enlarged view illustrating the relevant part (including an imaging device etc.) of the image forming apparatus.

Overall Structure of Image Forming Apparatus

An image forming apparatus 1 according to the first exemplary embodiment is configured as, for example, a color printer. The image forming apparatus 1 includes, for example, plural imaging devices 10, an intermediate transfer device 20, a paper feeding device 50, and a fixing device 40. Each of the imaging devices 10 forms a toner image developed with a toner contained in a developer 4. The intermediate transfer device 20 carries the respective toner images formed in the imaging devices 10 and transports the toner images to a secondary transfer position at which the toner images are finally secondarily transferred to recording paper 5 functioning as an example of a recording material. The paper feeding device 50 contains and transports the recording paper 5 to be supplied to the secondary transfer position of the intermediate transfer device 20. The fixing device 40 fixes the toner images that have been secondarily transferred to the recording paper 5 by the intermediate transfer device 20.

In the case where the image forming apparatus 1 additionally includes, for example, an image input device 60 that inputs a document image to be formed on the recording paper 5, the image forming apparatus 1 may be configured as a color copying machine. The image forming apparatus 1 includes a housing 1*a* including a supporting structural member, an exterior covering, etc. The alternate long and short dash line in the figure indicates a transport path through which the recording paper 5 is transported in the housing 1*a*.

Structure of Relevant Part of Image Forming Apparatus

The imaging devices 10 are six imaging devices 10Y, 10M, 10C, 10K, 10*s*1, and 10*s*2. The imaging devices 10Y, 10M, 10C, 10K exclusively form toner images of four colors of yellow (Y), magenta (M), cyan (C), and black (K), respectively. The imaging devices 10*s*1 and 10*s*2 exclusively form two toner images of special colors s1 and s2, respectively. These six imaging devices 10 (s1, s2, Y, M, C, and K) are arranged in a line in the internal space of the housing 1*a*. As the developers 4 (s1 and s2) for the special colors (s1 and s2), developers containing colorants of colors which are difficult or impossible to be expressed by the above four colors are used. Specific examples thereof include toners of colors other than the above four colors, toners having the same colors as the four colors and different chromas, transparent toners that improve the glossiness, foamable toners for Braille, and fluorescent color toners. These imaging devices 10 (s1, s2, Y, M, C, and K) have substantially common structure as described below except that the type of developer treated is different.

As illustrated in FIGS. 1 and 2, each of the imaging devices 10 (s1, s2, Y, M, C, and K) includes a rotatable photoconductor drum 11. For example, a charging device 12, an exposure device 13, a developing device 14, a primary transfer device 15, a pre-cleaning charging device 16, a drum cleaning device 17, and a charge erasing device 18 are arranged around the photoconductor drum 11. The charging device 12 charges a peripheral surface (image-carrying surface) of the photoconductor drum 11, on which an image is formed, to a certain potential. The exposure device 13 radiates light LB on the charged peripheral surface of the photoconductor drum 11 on the basis of image information (signal) to form an electrostatic latent image (for each color) having a potential difference. The developing device 14 (s1, s2, Y, M, C, or K) develops the electrostatic latent image with a toner of a developer 4 of corresponding color (s1, s2, Y, M, C, or K) to form a toner image. The primary transfer device 15 transfers the toner image to the intermediate transfer device 20. The pre-cleaning charging device 16 charges adhering substances, such as a toner, which remains and adheres to the image-carrying surface of the photoconductor drum 11 after a primary transfer. The drum cleaning device 17 removes the recharged adhering substance to perform cleaning. The charge erasing device 18 erases charges on the image-carrying surface of the photoconductor drum 11 after cleaning.

The photoconductor drum 11 is obtained by forming an image-carrying surface having a photoconductive layer (photosensitive layer) composed of a photosensitive material on a peripheral surface of a cylindrical or columnar base to be subjected to a grounding treatment. This photoconductor drum 11 is supported so as to rotate in the direction indicated by the arrow A by the transmission of a motive power from a rotary driving device (not illustrated).

The charging device 12 is a non-contact type charging device, such as a corona discharge device, which is arranged without contacting the photoconductor drum 11. A voltage for charging is supplied to a discharge member of the charging device 12. In the case where the developing device 14 conducts reversal development, a voltage or current having the same polarity as the charging polarity of the toner supplied from the developing device 14 is supplied as the voltage for charging.

The exposure device 13 radiates light (the arrow indicated by the dotted line) LB formed in accordance with image information input to the image forming apparatus 1 onto the peripheral surface of the photoconductor drum 11 after the peripheral surface has been charged to form an electrostatic latent image. In forming a latent image, image information (signal) input to the image forming apparatus 1 by any method is transmitted to the exposure device 13.

As illustrated in FIG. 2, each of the developing devices 14 (s1, s2, Y, M, C, or K) includes, for example, a housing 140 having an opening and a chamber of the developer 4, and two developing rollers 141 and 142, two stirring-transporting members 143 and 144 such as screw augers, and a layer-thickness control member 145, all of which are arranged in the housing 140. The developing rollers 141 and 142 hold the developer 4 and transport the developer 4 to two development regions facing the photoconductor drum 11. The stirring-transporting members 143 and 144 transport the developer 4 so that the developer 4 is caused to pass through the developing rollers 141 and 142 while stirring the developer 4. The layer-thickness control member 145 controls the amount (layer thickness) of the developer held on the developing rollers 141 and 142. A voltage for development is supplied from a power supply unit (not illustrated) between the photoconductor drum 11 and the developing rollers 141 and 142 of the developing device 14. The developing rollers 141 and 142 and the stirring-transporting members 143 and 144 are rotated in predetermined directions by the transmission of a motive power from a rotary driving device (not illustrated). Two-component developers each containing a non-magnetic toner and a magnetic carrier are used as the developers 4 (Y, M, C, and K) for the four colors and the developers 4 (s1 and s2) for the two special colors.

The primary transfer device 15 is a contact-type transfer device that rotates in contact with the peripheral surface of the photoconductor drum 11 and that includes a primary transfer roller to which a voltage for the primary transfer is supplied. As the voltage for the primary transfer, a DC voltage having a polarity opposite to the charging polarity of the toner is supplied from the power supply unit (not illustrated).

As illustrated in FIG. 2, the drum cleaning device 17 includes, for example, a container-shaped body 170, a part of which is opened, a cleaning plate 171, a rotary brush roller 172, and a sending member 173 such as a screw auger. The cleaning plate 171 is arranged to contact with the peripheral surface of the photoconductor drum 11 after the primary transfer at a certain pressure, and removes adhering substances such as a residual toner to clean the peripheral surface of the photoconductor drum 11. The rotary brush roller 172 is arranged so as to rotate while contacting the peripheral surface of the photoconductor drum 11 on the upstream side of the cleaning plate 171 in the rotation direction of the photoconductor drum 11. The sending member 173 collects adhering substances such as a toner removed by the cleaning plate 171 and transports the adhering substances so as to send to a recovery system (not illustrated). The cleaning plate 171 may be a plate member (e.g., a blade) composed of rubber or the like.

As illustrated in FIG. 1, the intermediate transfer device 20 is arranged below the imaging devices 10 (s1, s2, Y, M, C, and K). The intermediate transfer device 20 includes an intermediate transfer belt 21, plural belt support rollers 22 to 27, a secondary transfer device 30, and a belt cleaning device 28. The intermediate transfer belt 21 rotates in the direction indicated by the arrow B while passing through primary transfer positions between the photoconductor drums 11 and the primary transfer devices 15 (primary transfer rollers). The belt support rollers 22 to 27 hold the intermediate transfer belt 21 from the inner surface thereof in a desired state to rotatably support the intermediate transfer belt 21. The secondary transfer device 30 is arranged on the outer peripheral surface (image-carrying surface) side of the intermediate transfer belt 21 supported by the belt support roller 26, and secondarily transfers the toner image on the intermediate transfer belt 21 to the recording paper 5. The belt cleaning device 28 removes adhering substances such as a toner and paper dust which remain and adhere to the outer peripheral surface of the intermediate transfer belt 21 after the intermediate transfer belt 21 passes through the secondary transfer device 30 to perform cleaning.

For example, the intermediate transfer belt 21 may be an endless belt composed of a material in which a resistance adjusting agent such as carbon black is dispersed in a synthetic resin such as a polyimide resin or a polyamide resin. The belt support roller 22 functions as a drive roller. The belt support rollers 23, 25, and 27 function as driven rollers that hold the running position or the like of the intermediate transfer belt 21. The belt support roller 24 functions as a tension-applying roller. The belt support roller 26 functions as a back-up roller of a secondary transfer.

As illustrated in FIG. 1, the secondary transfer device 30 includes a secondary transfer belt 31 and plural belt support rollers 32 to 36. The secondary transfer belt 31 rotates in the direction indicated by the arrow C while passing through a secondary transfer position which is an outer peripheral surface portion of the intermediate transfer belt 21 supported by the belt support roller 26 in the intermediate transfer device 20. The belt support rollers 32 to 36 hold the secondary transfer belt 31 from the inner surface thereof in a desired state to rotatably support the secondary transfer belt 31. For example, the secondary transfer belt 31 may be an endless belt having substantially the same structure as the above-described intermediate transfer belt 21. The belt support roller 32 is arranged so that the secondary transfer belt 31 is pressed with a certain pressure against the outer peripheral surface of the intermediate transfer belt 21 supported by the belt support roller 26. The belt support roller 32 functions as a drive roller, and the belt support roller 36 functions as a tension-applying roller. A DC voltage having a polarity opposite to or the same as the charging polarity of the toner is supplied as a voltage for the secondary transfer to the belt support roller 32 of the secondary transfer device 30 or the belt support roller 26 of the intermediate transfer device 20.

The fixing device 40 includes, for example, a housing 41 having an inlet and an outlet for the recording paper 5, and a heating rotary member 42 and a drum-shaped pressure rotary member 43 that are arranged in the housing 41. The heating rotary member 42 includes a fixing belt that rotates in the direction indicated by the arrow and that is heated by a heater so that the surface temperature thereof is maintained at a predetermined temperature. The pressure rotary member 43 is driven and rotated while contacting the heating rotary member 42 substantially along the axial direction of the heating rotary member 42 at a predetermined pressure. In this fixing device 40, a contact portion between the heating rotary member 42 and the pressure rotary member 43 functions as a fixing treatment portion where a fixing treatment (heating and pressing) is performed.

The paper feeding device 50 is arranged below the intermediate transfer device 20 and the secondary transfer device 30. The paper feeding device 50 includes at least one paper container 51 and a sending device 52. The paper container 51 contains a desired type of recording paper 5 having a desired size etc. in a stacked manner. The sending device 52 sends the recording paper 5 from the paper container 51 one by one. The paper container 51 is attached so as to be able to be drawn out to the front (a side surface toward which a user faces during operation) side of the housing 1*a*.

Paper transport roller pairs 53 to 57 that transport the recording paper 5 sent from the paper feeding device 50 to the secondary transfer position and a paper feed transport path formed by a transport guiding material (not illustrated) are arranged between the paper feeding device 50 and the secondary transfer device 30. The paper transport roller pair 57 arranged right before the secondary transfer position in the paper feed transport path function as, for example, rollers (resist rollers) that adjust the transport timing of the recording paper 5. A paper transport device 58 having, for example, a belt shape, is provided between the secondary transfer device 30 and the fixing device 40. The paper transport device 58 transports the recording paper 5 after the secondary transfer, the recording paper 5 being sent from the secondary transfer belt 31 of the secondary transfer device 30, to the fixing device 40. A paper discharge roller pair 59 is arranged near a paper outlet formed in the housing 1*a*. The paper discharge roller pair 59 discharges the recording paper 5 after fixing sent from the fixing device 40 to the outside of the housing 1*a*.

The image input device 60 installed in the case of a color copying machine is an image reading device that reads an image of a document having image information to be printed, and is arranged, for example, above the housing 1*a* as illustrated in FIG. 1. The image input device 60 includes a document placing plate (platen glass) 61, a light source 62, a reflection mirror 63, a first reflection mirror 64, a second reflection mirror 65, an image reading element 66, imaging lens 67, etc. The document placing plate 61 is composed of a transparent glass plate or the like, and a document 6 having information of an image to be read is placed on the document placing plate 61. The light source 62 illuminates the document 6 placed on the document placing plate 61 while moving. The reflection mirror 63 receives light reflected from the document 6 while moving together with the light source 63 and reflects the light in a predetermined direction. The first reflection mirror 64 and the second reflection mirror 65 move a predetermined distance at a predetermined speed with respect to the reflection mirror 63. The image reading element 66 may be a charge coupled device (CCD) or the like that receives and reads light reflected from the document 6 and converts the light into an electrical signal. The imaging lens 67 focuses the reflected light on the mage reading element 66. An opening/closing cover 68 covers the document placing plate 61.

The image information of the document read and input by the image input device 60 is subjected to necessary image processing by an image processing device 70. First, in the image input device 60, the image information of the read document is transmitted to the image processing device 70 as, for example, image data (e.g., each 8-bit data) of three colors of red (R), green (G), and blue (B). The image processing device 70 performs predetermined image processing such as shading correction, misregistration correction, brightness/color space conversion, gamma correction, frame erasing, color/movement edition, etc. on the image data transmitted from the image input device 60. The image processing device 70 changes image signals after the image processing to respective image signals of the four colors (Y, M, C, and K) and then transmits the image signals to the exposure device 13. The image processing device 70 also generates image signals for the two special colors (s1 and s2).

Operation of Entire Part and Relevant Part of Image Forming Apparatus

A basic image forming operation of the image forming apparatus 1 will now be described.

First, a description will be made of, as a typical example, an image forming operation in the case where a full-color image is formed by combining toner images of four colors (Y, M, C, and K) using the four imaging devices 10 (Y, M, C, and K).

When the image forming apparatus 1 receives instruction information of a demand for an image forming operation (printing), the four imaging devices 10 (Y, M, C, and K), the intermediate transfer device 20, the secondary transfer device 30, the fixing device 40, etc. start to operate.

In each of the imaging devices 10 (Y, M, C, and K), first, the photoconductor drum 11 rotates in the direction indicated by the arrow A, and the charging device 12 charges the surface of the photoconductor drum 11 with a predetermined polarity (negative polarity in the first exemplary embodiment) and potential. Subsequently, the exposure device 13 radiates light LB on the surface of the photoconductor drum 11 after charging, the light LB being emitted on the basis of image signals obtained by converting information of images input to the image forming apparatus 1 to respective color components (Y, M, C, and K), to form, on the surface, an electrostatic latent image of each color component having a certain potential difference.

Subsequently, each of the developing devices 14 (Y, M, C, and K) supplies a toner of a corresponding color (Y, M, C, or K) charged with the predetermined polarity (negative polarity) from the developing rollers 141 and 142 to the electrostatic latent image of each color component formed on the photoconductor drum 11, and causes the toner to electrostatically adhere, thus conducting development. The electrostatic latent images of respective color components formed on the photoconductor drums 11 are visualized by this development as toner images of the four colors (Y, M, C, and K) developed with the toners of corresponding colors.

Subsequently, when the toner images of the respective colors formed on the photoconductor drums 11 of the imaging devices 10 (Y, M, C, and K) are transported to primary transfer positions, the primary transfer devices 15 primarily transfer the toner images of respective colors so that the toner images are sequentially overlapped with respect to the intermediate transfer belt 21 rotating in the direction indicated by the arrow B of the intermediate transfer device 20.

In each of the imaging devices 10 after the primary transfer is finished, the pre-cleaning charging device 16 recharges adhering substances such as a toner remaining on the surface of the photoconductor drum 11 after the primary transfer. The drum cleaning device 17 removes the recharged adhering substances so as to scrape the adhering substances to clean the surface of the photoconductor drum 11. Lastly, the charge erasing device 18 erases charges on the surface of the photoconductor drum 11 after cleaning. Thus, the imaging devices 10 are prepared so that the next imaging operation is performed.

Subsequently, in the intermediate transfer device 20, the toner images that have been subjected to the primary transfer are held and transported to the secondary transfer position by the rotation of the intermediate transfer belt 21. In the paper feeding device 50, the recording paper 5 is sent to the paper feed transport path in accordance with the imaging operation. In the paper feed transport path, the paper transport roller pair 57 functioning as resist rollers sends and supplies the recording paper 5 to the secondary transfer position in accordance with the transfer timing.

At the secondary transfer position, the secondary transfer device 30 secondarily transfers the toner images on the intermediate transfer belt 21 to the recording paper 5 at one time. In the intermediate transfer device 20 after the secondary transfer is finished, the belt cleaning device 28 removes adhering substances such as a toner remaining on the surface of the intermediate transfer belt 21 after the secondary transfer to clean the intermediate transfer belt 21.

Subsequently, the recording paper 5 on which the toner images are secondarily transferred is separated from the intermediate transfer belt 21 and the secondary transfer belt 31, and is then transported to the fixing device 40 by the paper transport device 58. In the fixing device 40, the recording paper 5 after the secondary transfer is introduced in and caused to pass through the contact portion between the rotatable heating rotary member 42 and pressure rotary member 43, whereby performing a fixing treatment (heating and pressing). Thus, unfixed toner is fixed to the recording paper 5. Lastly, in the case of an image forming operation for forming an image only on a single side of the recording paper 5, the recording paper 5 after fixing is discharged by the paper discharge roller pair 59 to, for example, a discharge container (not illustrated) installed outside the housing 1*a*.

The recording paper 5 on which a full-color image is formed by combining toner images of the four colors is output through the above operation.

Next, a description will be made of an operation in the case where special color toner images formed by the developers for the special colors s1 and s2 are formed in combination with, for example, the above-described typical image formation in the image forming apparatus 1.

In this case, first, an imaging operation is conducted in each of the imaging devices 10*s*1 and 10*s*2 as in the case of the imaging devices 10 (Y, M, C, and K). Thus, toner images of the special colors (s1 and s2) are respectively formed on the photoconductor drums 11 in the imaging devices 10*s*1 and 10*s*2. Subsequently, as in the case of the image forming operation related to the toner images of the four colors, the toner images of the special colors formed in the imaging devices 10*s*1 and 10*s*2 are primarily transferred to the intermediate transfer belt 21 of the intermediate transfer device 20, and then secondarily transferred from the intermediate transfer belt 21 to the recording paper 5 (together with the toner images of the other colors) by the secondary transfer device 30. Lastly, the recording paper 5 to which the toner images of the special colors and the toner images of the other colors have been secondarily transferred is subjected to a fixing treatment in the fixing device 40, and then discharged to the outside of the housing 1*a*.

Through the above operation, the recording paper 5 on which the two toner images of the special colors are overlapped over the entire surface or on a part of the full-color image formed by combining the toner images of the four colors is output.

Furthermore, in the case where the image forming apparatus 1 is a color copying machine including the image input device 60, a basic image forming operation of the image forming apparatus 1 is performed as follows.

Specifically, in this case, when the document 6 is set on the image input device 60 and the image forming apparatus 1 receives instruction information of a demand for an image forming operation (copying), a document image of the document 6 is read in the image input device 60. The information of the read document image is then subjected to the image processing in the image processing device 70 as described above, and generated as signals of the image. Subsequently, the signals of the image are transmitted to the exposure device 13 in each of the imaging devices 10 (s1, s2, Y, M, C, and K). Thus, in each of the imaging devices 10, the formation of an electrostatic latent image and the formation of a toner image are performed on the basis of the image information of the document 6. Thereafter, the same operation as in the case of the image forming operation (printing) is performed. Lastly, an image corresponding to the toner images is formed on the recording paper 5, and output.

Detailed Structure of Relevant Part of Image Forming Apparatus

Next, the relevant part (including the developing device in the imaging device) of the image forming apparatus 1 will be described in detail.

Detailed Structure of Developing Device

First, the structure of the developing devices 14 in the imaging devices 10 will be described in detail.

Figure 3:
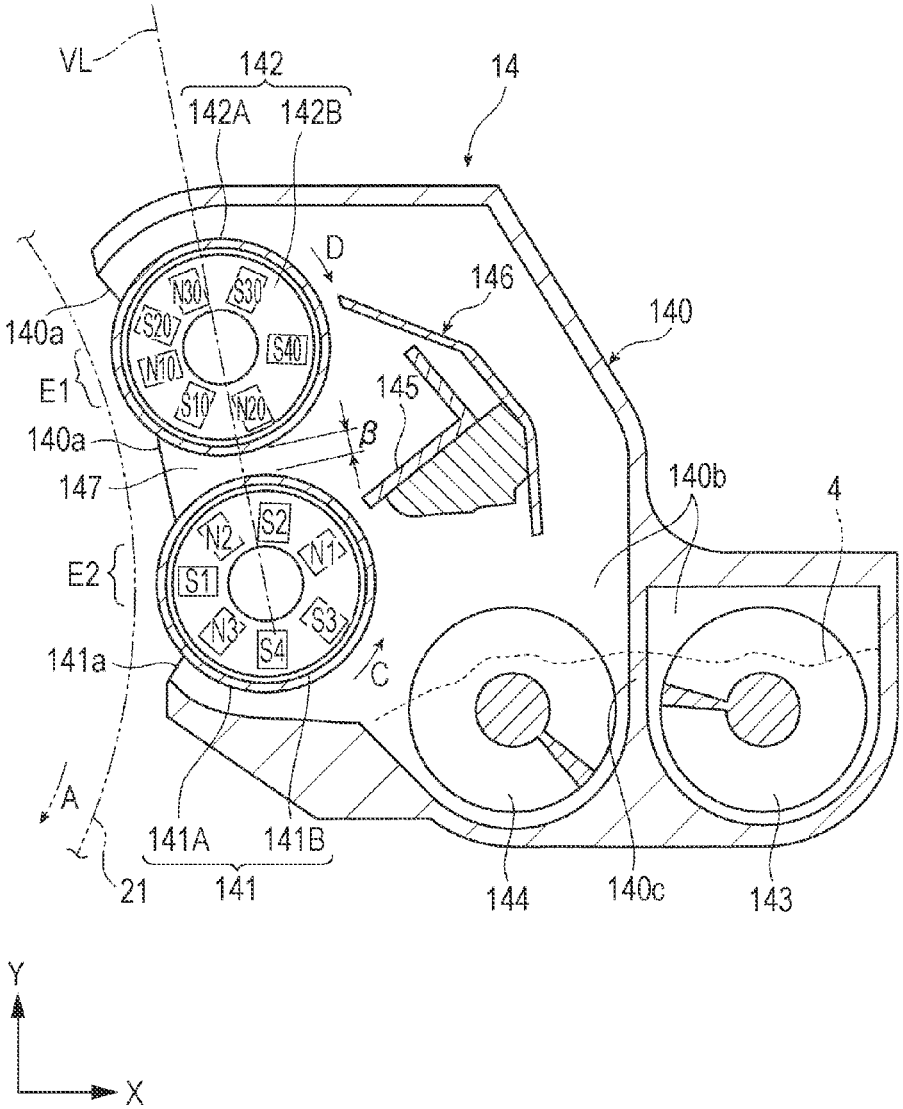
FIG. 3 is a cross-sectional view illustrating the structure of a developing device in the imaging device illustrated in FIG. 2.

As illustrated in FIGS. 2, 3, etc., each of the developing devices 14 (s1, s2, Y, M, C, and K) includes a housing 140 having a rectangular opening 140*a* formed at a position facing the photoconductor drum 11 and a storage chamber 140*b* that stores a developer 4 (s1, s2, Y, M, C, or K). The developer 4 is the above-described two-component developer containing a non-magnetic toner and a magnetic carrier.

This housing 140 has a long container-like shape having a length exceeding the length of the photoconductor drum 11 in the axial direction. The storage chamber 140*b* is formed so that a bottom portion of the storage chamber 140*b* has two developer circulating transport paths (groove portions). Specifically, the developer circulating transport paths are two grooves extending in parallel, and are connected to each other at both ends in the longitudinal direction. In addition, the two grooves are partitioned by a partition wall 140*c* that protrudes at a central portion between the grooves in the longitudinal direction. A certain amount of a two-component developer 4 is contained in the storage chamber 140*b* in advance. The storage chamber 140*b* is replenished with a certain amount of fresh developer 4 (it may be a developer containing only a toner) from a developer storage container and a replenishment device (not illustrated) at an appropriate timing.

In the developing device 14, two developing rollers 141 and 142 (hereinafter also referred to as "first developing roller 141" and "second developing roller 142"), two screw augers 143 and 144, a passage control plate 145, a recovery guiding plate 146, etc. are arranged in the housing 140. The developing rollers 141 and 142 rotate without contacting the photoconductor drum 11, and transport the developer 4 to two developing regions E2 and E1, respectively, facing the photoconductor drum 11 while holding the developer 4 thereon with a magnetic force. The screw augers 143 and 144 are an example of stirring-transporting members that stir and transport the developer 4 contained in the storage chamber 140*b*. The passage control plate 145 is an example of a layer-thickness control member that controls the passage of the developer 4 supplied from the screw auger 144 to the first developing roller 141 to control the thickness of the layer of the developer 4 (the amount of developer transported). The recovery guiding plate 146 guides the developer 4 separated from the second developing roller 142 so as to return the developer 4 to the storage chamber 140*b*. Regarding the two developing regions E1 and E2, hereinafter, the developing region E1 located on the upstream side in the rotation direction A of the photoconductor drum 11 may be referred to as "upstream developing region", and the developing region E2 located on the downstream side of the upstream developing region E1 in the rotation direction A may be referred to as "downstream developing region".

Figure 4:
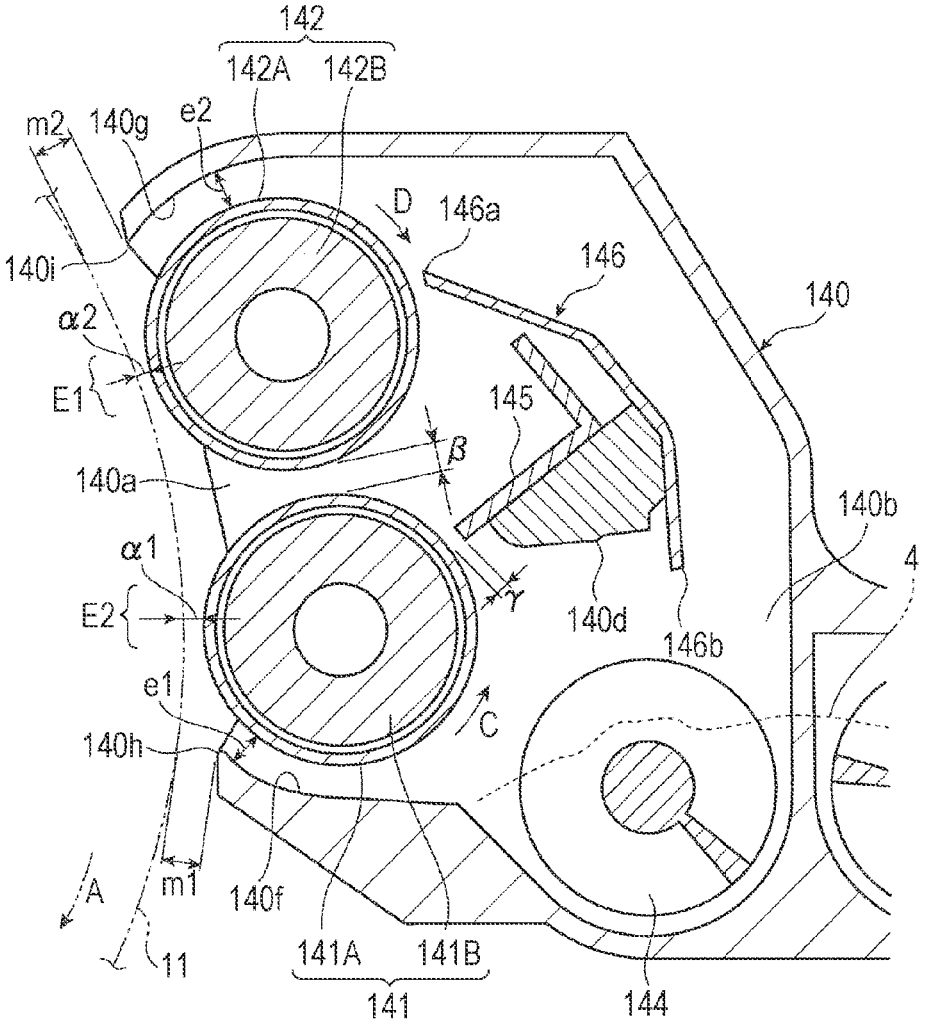
FIG. 4 is an enlarged cross-sectional view illustrating the detailed structure of the developing device illustrated in FIG. 3.

As illustrated in FIGS. 3, 4, etc., the first developing roller 141 and the second developing roller 142 are arranged in the housing 140 so as to rotate in particular directions C and D, respectively, in a state where a part of each of the developing rollers 141 and 142 is exposed through the opening 140*a*. The two developing rollers 141 and 142 are respectively arranged with certain gaps (minimum distances, development gaps) $\alpha 1$ and $\alpha 2$ between themselves and the surface of the photoconductor drum 11. The developing rollers 141 and 142 are arranged with a certain gap (minimum distance) $\beta$ therebetween in the rotation direction A of the photoconductor drum 11. A portion (space) where the developing rollers 141 and 142 are closest to each other is formed as a closest portion 147. In general, the distance $\alpha 1$ between the first developing roller 141 and the photoconductor drum 11 and the distance a2 between the second developing roller 142 and the photoconductor drum 11 are each set to a value smaller than the distance $\beta$ between the two developing rollers 141 and 142 ($\alpha 1<\beta$, $\alpha 2<\beta$). The distances $\alpha 1$ and $\alpha 2$ may be set to the same value or different values.

The first developing roller 141 includes a cylindrical sleeve 141A and a magnet roller 141B. The sleeve 141A is supported so as to rotate in the direction of the arrow C with there being the certain distance $\alpha 1$ between itself and the downstream developing region E2 of the outer peripheral surface of the photoconductor drum 11. The magnet roller 141B is provided so as to be fixed inside the sleeve 141A. The rotation direction C of the sleeve 141A is determined so that the moving direction of the sleeve 141A in the downstream developing region E2 of the photoconductor drum 11 is the same as the rotation (moving) direction A of the photoconductor drum 11.

The second developing roller 142 includes a cylindrical sleeve 142A and a magnet roller 142B. The sleeve 142A is supported so as to rotate in the direction of the arrow D with there being the certain distance $\alpha 2$ between itself and the upstream developing region E1 of the outer peripheral surface of the photoconductor drum 11. The magnet roller 142B is provided so as to be fixed inside the sleeve 142A. The rotation direction D of the sleeve 142A is determined so that the moving direction of the sleeve 142A in the upstream developing region E1 of the photoconductor drum 11 is opposite to the rotation (moving) direction A of the photoconductor drum 11.

Each of the sleeves 141A and 142A is composed of a non-magnetic material (such as stainless steel or aluminum), and at least includes a cylindrical portion having a width (length) substantially the same as an image forming effective region in the axial direction of the rotation of the photoconductor drum 11. The sleeves 141A and 142A are each arranged so that the axial direction of the rotation thereof is substantially parallel to the axial direction of the photoconductor drum 11. In addition, both ends of each of the sleeves 141A and 142A are formed as shaft portions. A distance-holding ring (tracking roll) (not illustrated) that is larger than the outer peripheral surface of the sleeve by the dimension of the distance $\alpha 1$ or $\alpha 2$ is attached to each of the ends. The sleeves 141A and 142A are each rotatably bearing-supported with respect to side surface portions of the housing 140 so that the sleeves 141A and 142A rotate while the distance-holding ring is pressed on the outer peripheral surface of the photoconductor drum 11 with a certain pressure.

The sleeves 141A and 142A receive a necessary rotational motive power from a rotary driving device or the like (not illustrated) at an end of the respective shaft portions thereof and are rotated in the directions indicated by the arrows C and D, respectively. Furthermore, a developing voltage for forming a developing electric field is applied from a power supply device (not illustrated) between the photoconductor drum 11 and each of the sleeves 141A and 142A. For example, a DC voltage on which an AC component is superimposed is applied as the developing voltage.

Each of the magnet rollers 141B and 142B has a structure in which plural magnetic poles (S-pole and N-pole) are arranged. The magnetic poles generate lines of magnetic force or the like with which a magnetic carrier in the two-component developer 4 is held on the outer peripheral surfaces of the sleeves 141A and 142A while forming a carrier chain (magnetic brush). For example, the magnet rollers 141B and 142B are attached so that both ends of each of the magnet rollers 141B and 142B are fixed to side surface portions of the housing 140 through inner spaces in the shaft portions of the sleeves 141A and 142A. The magnetic poles each extend in the axial directions of the sleeves 141A and 142A, and arranged at predetermined positions at intervals in the circumferential directions (rotation directions) of the sleeves 141A and 142A.

Each of the screw augers 143 and 144 has a structure in which a transport blade is wound around a peripheral surface of a rotary shaft in a spiral manner. As illustrated in FIG. 3 etc., the screw augers 143 and 144 are rotatably arranged in the two developer circulating transport paths in the storage chamber 140*b* of the housing 140, and rotate in a direction in which the developer 4 present in each of the circulating transport paths is transported in a predetermined direction. A part of a motive power for rotating each of the sleeves 141A and 142A in the developing rollers 141 and 142 is branched by a drive transmission mechanism such as a gear and transmitted to the screw augers 143 and 144, whereby the screw augers 143 and 144 are rotated. The screw auger 144 arranged at a position close to the first developing roller 141 transports the developer 4 and supplies a part of the developer 4 to the first developing roller 141.

As illustrated in FIGS. 3, 4, etc., the passage control plate 145 is a rectangular plate having at least a length (long side) equal to the length of the sleeve 141A of the first developing roller 141 in the axial direction, and has a portion having a substantially uniform thickness. The passage control plate 145 is composed of a non-magnetic material such as stainless steel. Furthermore, the passage control plate 145 is attached to a support 140*d*, which is a part of the housing 140, so that one end in the longitudinal direction (a lower long-side portion) of the passage control plate 145 in cross-sectional view faces the outer peripheral surface of the sleeve 141A with a certain distance (control distance) $\gamma$ therebetween and the passage control plate 145 extends in the axial direction of the sleeve 141A and faces the sleeve 141A. The passage control plate 145 in the first exemplary embodiment is a plate having a shape in which the other end is bent so that the entire cross section has an L-shape. The distance $\gamma$ between the passage control plate 145 and the first developing roller 141 is set to be smaller than the distance $\beta$ between the two developing rollers 141 and 142 ($\gamma<\beta$).

The recovery guiding plate 146 is a plate having a surface that receives developer separated from the second developing roller 142 and then allows the developer to slide and drop so as to return the developer to the storage chamber 140*b*. As illustrated in FIG. 3 etc., the recovery guiding plate 146 is attached to the support 140*d* of the housing 140 so that an upper end portion 146*a* of the recovery guiding plate 146 faces the outer peripheral surface of the sleeve 142A at a position of, for example, separation poles in the second developing roller 142 with a predetermined distance therebetween and a lower end portion 146*b* thereof gradually extends from the upper end portion 146*a* toward the lower side and reaches a position close to the upper portion of the screw auger 144.

As illustrated in FIG. 3, the magnet roller 141B of the first developing roller 141 in the developing device 14 includes seven magnetic poles, namely, S3, N1, S2, N2, S1, N3, and S4. The alternate long and short dash line VL in FIG. 3 etc. is a straight line joining the center (O1) of the first developing roller 141 and the center (O2) of the second developing roller 142.

Among these magnetic poles, the magnetic pole S3 is arranged at a position substantially facing an upper end portion on the photoconductor drum 11 side of the screw auger 144, which is arranged close to the first developing roller 141. The magnetic pole S3 functions as a pole that performs pick-up. Specifically, the magnetic pole S3 attracts the developer 4 supplied from the screw auger 144 with a magnetic force to the outer peripheral surface of the sleeve 141A, and holds the developer 4. The magnetic pole N1 is a pole for control assistance, that is, a pole for assisting the control action performed by the passage control plate 145 on the developer 4 so that a magnetic brush having an appropriate size stands erect. The magnetic pole S2 is arranged at a position close to the second developing roller 142, and functions as a first transfer magnetic pole that generates a line of magnetic force for forming a path for transferring a part of the developer 4 transported by the first developing roller 141 to the outer peripheral surface side of the sleeve 142A of the second developing roller 142. The magnetic pole N2 is a transport pole that transports the developer remaining after the transfer to the second developing roller 142. The magnetic pole S1 is arranged at a position facing the downstream developing region E2 of the photoconductor drum 11, and functions as a development pole that causes the developer 4 to contribute to a developing step. The magnetic poles S4 and S3 function as poles that perform pick-off. Specifically, the magnetic poles S4 and S3 generate a repulsive magnetic force with the same polarity to separate the developer from the outer peripheral surface of the sleeve 141A after the developing step in the downstream developing region E2 is finished.

As illustrated in FIG. 3, the magnet roller 142B of the second developing roller 142 in the developing device 14 includes seven magnetic poles, namely, N20, S10, N10, S20, N30, S30, and S40.

Among these magnetic poles, the magnetic pole N20 is arranged so as to substantially face the first transfer magnetic pole S2 in the first developing roller 141, and functions as a second transfer magnetic pole that generates a line of magnetic force for forming a path for transferring a part of the developer 4 transported by the first developing roller 141 to the outer peripheral surface side of the sleeve 142A of the second developing roller 142 in cooperation with the first transfer magnetic pole S2. The magnetic pole S10 is a transport pole that transports the developer transferred from the first developing roller 141. The magnetic pole N10 is arranged at a position facing the upstream developing region E1 of the photoconductor drum 11, and functions as a development pole that causes the developer 4 to contribute to the developing step. The magnetic poles S20 and N30 are transport poles that transport the developer after the developing step in the upstream developing region E1 is finished. The magnetic poles S30 and S40 function as poles that perform pick-off. Specifically, the magnetic poles S30 and S40 generate a repulsive magnetic field (line of magnetic force) with the same magnetism to separate the developer 4 from the outer peripheral surface of the sleeve 142A.

As illustrated in FIG. 4, in each of the developing devices 14 (s1, s2, Y, M, C, and K), regarding a minimum distance e1 between an inner surface portion 140*f* extending to the opening 140*a* of the housing 140 and (the sleeve 141A of) the first developing roller 141 arranged close to the inner surface portion 140*f*, and a minimum distance e2 between an inner surface portion 140*g* extending to the opening 140*a* of the housing 140 and (the sleeve 142A of) the second developing roller 142 arranged close to the inner surface portion 140*g*, each of the minimum distances e1 and e2 is set to a value equal to or larger than a minimum distance (gap) β between the two developing rollers 141 and 142 (e1≥β, e2≥β). In addition, in each of the developing devices 14, regarding minimum distances m1 and m2 between the housing 140 and the outer peripheral surface of the photoconductor drum 11, each of the minimum distances m1 and m2 is set to a value equal to or larger than the minimum distance β between the two developing rollers 141 and 142 (m1≥β, m2≥β). The minimum distance β between the two developing rollers 141 and 142 is set to be smaller than each of the development gaps α1 and α2 (β<α1, β<α2) as described above.

The inner surface portions 140*f* and 140*g* extending to the opening 140*a* of the housing 140 respectively face outer peripheral surface portions on the photoconductor drum 11 side of the first developing roller 141 and the second developing roller 142, and constitute inner surface portions extending to long-side edges 140*h* and 140*i*, respectively, which are lower and upper portions of the opening 140*a*. In addition, the minimum distances m1 and m2 between the housing 140 and the outer peripheral surface of the photoconductor drum 11 form gaps between the outer peripheral surface of the photoconductor drum 11 and portions of the housing 140 that are closest to the outer peripheral surface of the photoconductor drum 11. The first exemplary embodiment exemplifies a case where the portions that are closest to the outer peripheral surface of the photoconductor drum 11 are the long-side edges 140*h* and 140*i* which are lower and upper portions of the opening 140*a*. A leak-preventing member (not illustrated) for preventing leakage of the developer 4 is interposed (in a gap) between each end of the two developing rollers 141 and 142 in the longitudinal direction and a side surface portion of the housing 140 so as to eliminate an unnecessary space.

Detailed Structure of Photoconductor Drum

Next, the structure of the photoconductor drum 11 in the imaging device 10 will be described in detail.

Figure 5A:
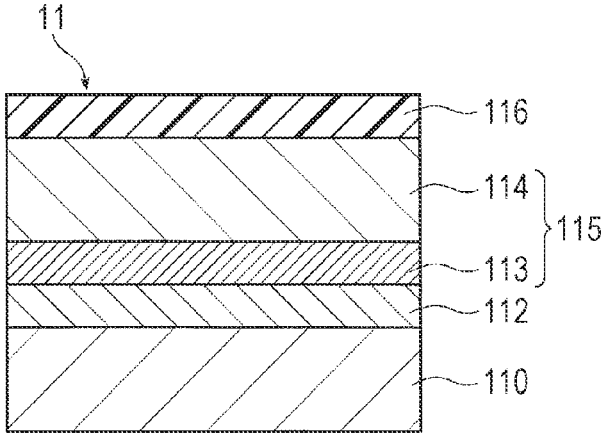
FIGS. 5A to 5C are each a schematic cross-sectional view illustrating a typical layer structure of a photoconductor drum.

As illustrated in FIG. 5A, the photoconductor drum 11 is a so-called function-separating photoconductor (or multilayer photoconductor). The photoconductor drum 11 includes, from the bottom, a conductive support 110, an underlayer 112, a function-separating photosensitive layer 115 formed by sequentially forming a charge generating layer 113 and a charge transporting layer 114, and a protective layer 116 functioning as a top surface layer, in that order.

Figure 5B:
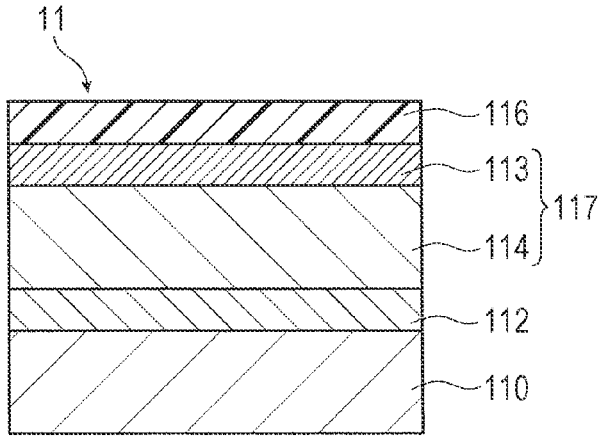
Figure 5C:
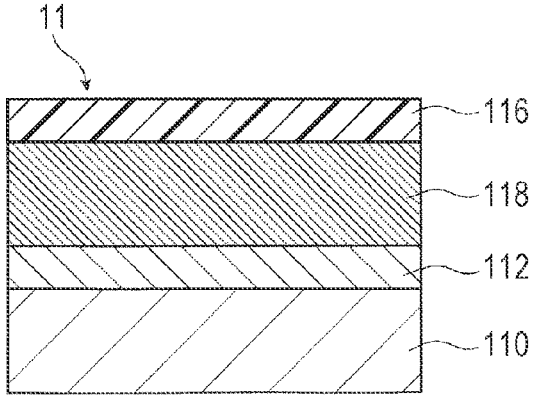

As illustrated in FIG. 5B, the photoconductor drum 11 may have a structure including a function-separating photosensitive layer 117 formed by sequentially forming the charge transporting layer 114 and the charge generating layer 113 in that order, instead of the photosensitive layer 115 in the photoconductor drum 11 (FIG. 5A). Alternatively, as illustrated in FIG. 5C, the photoconductor drum 11 may be a so-called function-integrated photoconductor in which a charge generating layer and a charge transporting layer are included in the same layer (function-integrated photosensitive layer). Specifically, an underlayer 112 may be provided on a conductive support 110, and a function-integrated photosensitive layer 118 and a protective layer 116 may be formed on the underlayer 112 in that order.

Protective Layer

The protective layer 116 is a top surface layer of the photoconductor drum 11, and is provided in order to protect the photosensitive layer 115 (117 or 118).

Charge-Transporting Monomer Having Hydroxyl Group

The protective layer 116 has a cross-linked structure formed by dehydration condensation of a charge-transporting monomer having a hydroxyl group. The charge-transporting monomer that forms the cross-linked structure in the protective layer 116 has at least one hydroxyl group. In particular, with the increase in the number of hydroxyl groups, the cross-linking density increases, a cross-linked film having a higher strength is obtained, and wear resistance of the photosensitive layer may be improved. In order to improve the cross-linking density, the charge-transporting monomer may have, as a reactive group other than a hydroxyl group, a substituent selected from an alkoxy group, an amino group, a thiol group, and a carboxyl group.

The charge-transporting monomer having a hydroxyl group is preferably a compound represented by general formula (I):

$$F—((—R_1—X)_{n1}(R_2)_{n2}—Y)_{n3} \quad (I)$$

In general formula (I), F represents an organic group derived from a compound having a hole-transporting capability. $R_1$ and $R_2$ each independently represent a linear or branched alkylene group having 1 to 5 carbon atoms, n1 represents 0 or 1, n2 represents 0 or 1, and n3 represents an integer of 1 or more and 4 or less. X represents oxygen, NH, or a sulfur atom. Y represents a substituent selected from a hydroxyl group, an alkoxy group, an amino group, a thiol group, and a carboxyl group, and at least one of Y's represents a hydroxyl group.

In general formula (I), examples of the compound having a hole-transporting capability in the organic group represented by F include arylamine derivatives. Examples of the arylamine derivatives include triphenylamine derivatives and tetraphenylbenzidine derivatives.

The compound represented by general formula (I) is preferably a compound represented by general formula (II) below. In particular, the compound represented by general formula (II) has, for example, a high charge mobility, high stability against oxidation or the like.

(II)

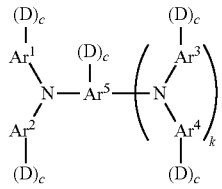

In general formula (II), $Ar^1$ to $Ar^4$ may be the same or different, and each independently represent a substituted or unsubstituted aryl group, $Ar^5$ represents a substituted or unsubstituted aryl group or a substituted or unsubstituted arylene group, D represents $—(—R_1—X)_{n1}(R_2)_{n2}—Y$ (where $R_1$ and $R_2$ each independently represent a linear or branched alkylene group having 1 to 5 carbon atoms, n1 represents 0 or 1, n2 represents 0 or 1, X represents oxygen, NH, or a sulfur atom, Y represents a substituent selected from a hydroxyl group, an alkoxy group, an amino group, a thiol group, and a carboxyl group, and at least one of Y's represents a hydroxyl group), c's each independently represent 0 or 1, k represents 0 or 1, and the total number of D's is 1 or more and 4 or less.

In general formula (II), "—(—$R_1$—X)$_{n1}$($R_2$)$_{n2}$—Y" represented by D is the same as that of general formula (I). Each of n1 and n2 is preferably 1, X is preferably oxygen, and at least one of Y's is a hydroxyl group.

The total number of D's in general formula (II) corresponds to n3 in general formula (I), is preferably 2 or more and 4 or less, and more preferably 3 or more and 4 or less. Specifically, by controlling the total number of D's in general formula (I) or general formula (II) to preferably 2 or more and 4 or less, and more preferably 3 or more and 4 or less per molecule, the cross-linking density is increased to obtain a cross-linked film having a higher strength.

Tetrafluoroethylene-Based Particles

The protective layer 116 preferably contains tetrafluoroethylene-based particles containing a polymer having a constituent unit derived from tetrafluoroethylene. In this case, with the abrasion of the protective layer 116, the tetrafluoroethylene-based particles are easily deformed into substantially a thin-film by a member that contacts the surface of the photoconductor drum 11. As a result, a thin film of the polymer having the constituent unit derived from tetrafluoroethylene is formed on the surface of the photoconductor drum 11.

Examples of the polymer having the constituent unit derived from tetrafluoroethylene include polymers of tetrafluoroethylene and copolymers of tetrafluoroethylene and other monomers. Specifically, preferred examples thereof include polytetrafluoroethylene (PTFE), tetrafluoroethylene-hexafluoropropylene copolymers (FEP), and tetrafluoroethylene-perfluoroalkyl vinyl ether copolymers (PFA). In particular, PTFE is preferable.

The tetrafluoroethylene-based particles contained in the protective layer 116 preferably have a volume average particle diameter of 1 μm or less. This particle diameter is more preferably 0.05 μm or more and 0.5 μm or less, and particularly preferably 0.1 μm or more and 0.3 μm or less. This particle diameter is measured using a measurement liquid prepared by diluting a dispersion liquid of tetrafluoroethylene-based particles with the same solvent as that of the dispersion liquid at a refractive index of 1.35 with a laser diffraction particle size distribution analyzer (produced by HORIBA, Ltd., LA-920).

The protective layer 116 may contain other components such as fluoroalkyl group-containing copolymers, guanamine compounds, melamine compounds, and conductive particles besides the cross-linked product formed by dehydration condensation of the charge-transporting monomer having a hydroxyl group and the tetrafluoroethylene-based particles containing a polymer having a constituent unit derived from tetrafluoroethylene.

Other Components

In order to improve the contamination resistance and lubricity of the surface of the photoconductor drum 11, oil such as silicone oil may be added to the protective layer 116. In addition, other thermosetting resins such as a phenolic resin, a melamine resin, a urea resin, an alkyd resin, and a benzoguanamine resin may be mixed in the protective layer 116. Furthermore, a surfactant, an antioxidant, a curing catalyst, and the like may be added to the protective layer 116.

Formation of Protective Layer

For example, in the case of a function-separating photoconductor drum 11, an underlayer 112, a charge generating layer 113, and a charge transporting layer 114 are sequentially formed on a conductive support 110, and a protective layer 116 is then formed by applying a coating liquid for forming a protective layer and conducting cross-linking. Examples of the catalyst used for forming the protective layer 116 include alicyclic ketone compounds such as cyclobutanone, cyclopentanone, cyclohexanone, and cycloheptanone. Examples of the coating method for forming the protective layer 116 include ring dip coating, ring coating, blade coating, Meyer-bar coating, spray coating, dip coating, bead coating, air-knife coating, curtain coating, and ink jet coating. After the coating, curing (cross-linking) is conducted by heating at a temperature of, for example, 100° C. or higher and 170° C. or lower to obtain the protective layer 116. From the standpoint of realizing a long lifetime and high stability of image quality, the thickness of the protective layer 116 is preferably in the range of 1 μm or more and 20 μm or less.

Conductive Support

Examples of the conductive support 110 include drums of a metal such as aluminum, copper, iron, stainless steel, zinc, or nickel; supports obtained by depositing a metal such as aluminum, copper, gold, silver, platinum, palladium, titanium, nickel-chromium, stainless steel, or copper-indium on a base composed of a sheet, paper, a plastic, or glass by vacuum evaporation; supports obtained by depositing a conductive metal compound such as indium oxide or tin oxide on the base described above by vacuum evaporation; supports obtained by laminating a metal foil on the base; and supports obtained by performing a conductive treatment by dispersing carbon black, indium oxide, a tin oxide-antimony oxide powder, a metal powder, copper iodide, or the like in a binder resin, and applying the resulting dispersion product onto the base. Note that the term "conductive" refers to a property that the volume resistivity is less than $10^{13}$ Ω·cm.

When the conductive support 110 is used in the photoconductor drum 11, the conductive support 110 has a drum shape. When the conductive support 110 is used in a photoconductor having a shape other than a drum, the conductive support 110 may have a sheet (belt) shape, a plate shape, or the like. For example, in the case where a metal pipe is used as the conductive support 110, the surface of the support formed of the pipe may be the surface of the original pipe. Alternatively, the surface of the support may be roughened by a surface treatment in advance. In the case where the surface is roughened and a coherent light source such as a laser beam is used as an exposure light source, it is possible to prevent the occurrence of a wood-grain-like uneven density caused by interference light that may be generated in the photoconductor drum 11. From the standpoint of improving adhesion of the photosensitive layer 115 (117 or 118) and a film formation property thereof, for example, a support prepared by anodizing an aluminum surface may be used as the conductive support.

Underlayer

The underlayer 112 is provided for the purpose of, for example, preventing light reflection on the surface of the conductive support 110 and preventing inflow of unnecessary carriers from the conductive support 110 to the protective layer 116. However, the underlayer 112 may not be necessarily formed. An interlayer may further be provided on the underlayer 112.

Examples of the material of the underlayer 112 include metal powders and electrically conductive metal oxides. The underlayer 112 may contain an acceptor compound (electron acceptor substance).

Charge Generating Layer

The charge generating layer 113 is formed by depositing a charge generating material by vacuum evaporation or by adding a charge generating material to an organic solvent and a binder resin, dispersing the resulting mixture, and applying the resulting dispersion.

Examples of the charge generating material include inorganic photoconductors such as amorphous selenium, crystalline selenium, selenium-tellurium alloys, selenium-arsenic alloys, other selenium compounds, selenium alloys, zinc oxide, and titanium oxide; photoconductors obtained by sensitizing any of these with a dye; phthalocyanine compounds such as metal-free phthalocyanines, titanyl phthalocyanine, copper phthalocyanine, tin phthalocyanine, and gallium phthalocyanine; organic pigments and dyes such as squarylium, anthanthrone, perylene, azo, anthraquinone, pyrene, pyrylium salts, and thiapyrylium salts. Among these materials, phthalocyanine compounds are preferable. In this case, when the photosensitive layer is irradiated with light, a phthalocyanine compound contained in the photosensitive layer absorbs photons and generates carriers. Since the phthalocyanine compound has a high quantum efficiency, the phthalocyanine compound efficiently absorbs photons and generates carriers.

In order to improve the sensitivity, to reduce the residual potential, and to reduce the fatigue during repeated use, the charge generating layer 113 may contain at least one electron acceptor substance. Furthermore, the charge generating layer 113 preferably contains water-repellent fine particles from the standpoint that, for example, moisture adsorption on the surface of the photoconductor drum 11 is suppressed, and even when the image forming apparatus is left standing for a long time, it is possible to suppress a change in the sensitivity of the photoconductor drum 11 due to the influence between an unreacted hydroxyl group contained in the cross-linked charge transporting layer and a small amount of water contained in the developer (toner) 4. Examples of the water-repellent fine particles include particles of polytetrafluoroethylene (PTFE), tetrafluoroethylene-hexafluoropropylene copolymers (FEP), and tetrafluoroethylene-perfluoroalkyl vinyl ether copolymers (PFA), and tetrafluoroethylene-based particles.

The thickness of the charge generating layer 113 is preferably in the range of 0.01 μm or more and 5 μm or less, and more preferably in the range of 0.05 μm or more and 2.0 μm or less.

Charge Transporting Layer

The charge transporting layer 114 is formed by applying a solution containing a charge transporting material and a binder resin or a solution containing a polymer charge transporting material.

Known charge transporting materials may be used, and examples thereof include hole transporting substances and electron transporting substances. The thickness of the charge transporting layer 114 after drying is preferably in the range of 5 μm or more and 50 μm or less, and more preferably in the range of 10 μm or more and 40 μm or less.

Details of Developer

The toner in each of the developers 4 (s1, s2, Y, M, C, and K) used in the developing devices 14 is produced by an emulsion polymerization aggregation method. In this method, a dispersion liquid prepared by emulsion polymerization of a polymerizable monomer of a binder resin is mixed with dispersion liquids of a colorant, a release agent, a charge control agent, etc., aggregation of particles is caused, and the particles are melted and coalesced by heating to obtain toner particles. In this case, the toner particles may be produced by a wet process in which an aggregation step is conducted in two stages. The water content of the toner produced by this emulsion polymerization aggregation method is higher than that of a toner produced by a pulverization method. The toner produced by the emulsion polymerization aggregation method usually contains water in an amount of 0.5% by weight or more and 2% by weight or less.

More specifically, the emulsion polymerization aggregation method is a method for producing a toner, the method including a step of forming aggregated particles by mixing a resin particle dispersion liquid containing resin particles dispersed therein, a colorant particle dispersion liquid containing colorant particles dispersed therein, a release agent dispersion liquid containing a release agent dispersed therein, an aggregating agent, and the like, and heating the resulting mixture to aggregate the resin particles, the colorant particles, release agent particles, etc., thereby forming aggregated particles, and a step of forming toner particles by heating the aggregated particles to a temperature equal to or higher than the glass transition temperature of the resin particles to coalesce the particles.

Description of Operation of the Relevant Part of Image Forming Apparatus with Reference to Detailed Structure Next, a description will be made of an operation of the imaging devices 10 when the developing devices 14, the photoconductor drums 11, and the developers 4 are used.

Figure 6:
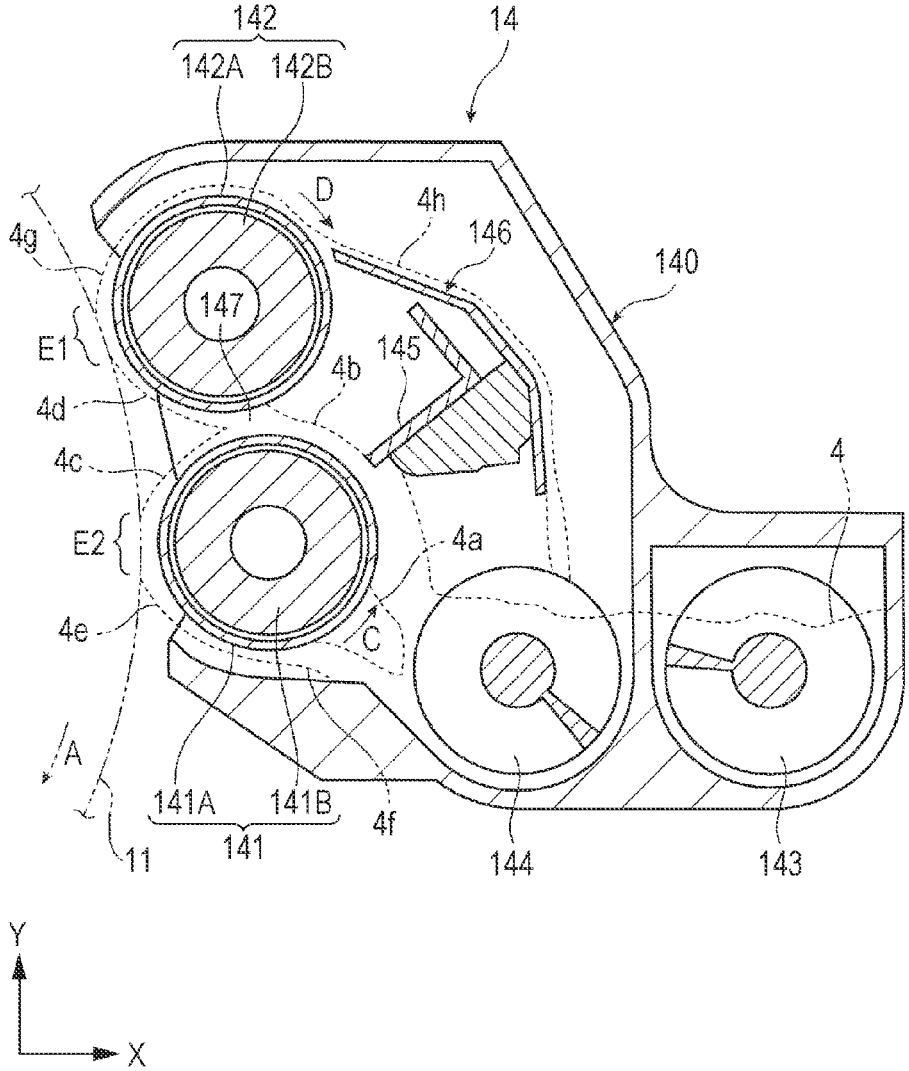
FIG. 6 is a view illustrating an operating state of the developing device illustrated in FIG. 3.

First, when the image forming apparatus 1 starts the operation of image formation, each of the developing devices (s1, s2, Y, M, C, and K) in the imaging devices 10 operates as follows. As illustrated in FIG. 6 etc., the sleeve 141A of the first developing roller 141, the sleeve 142A of the second developing roller 142, and the screw augers 143 and 144 respectively start to rotate in predetermined directions, and a certain developing voltage is supplied to each of the sleeves 141A and 142A.

Consequently, each of the two-component developers 4 (s1, s2, Y, M, C, and K) contained in the storage chamber 140*b* of the housing 140 is transported in the two circulating transport paths in the storage chamber 140*b* in particular directions while being stirred by the rotating screw augers 143 and 144 so that the two-component developer 4 is circulated as a whole. In this case, a non-magnetic toner in the developer 4 is sufficiently stirred with a magnetic carrier and subjected to triboelectrification, and electrostatically adheres to the surface of the carrier.

Subsequently, as illustrated in FIG. 6, a portion 4*a* of the two-component developer 4 transported by the screw auger 144 arranged close to the first developing roller 141 is held on the outer peripheral surface of the sleeve 141A of the first developing roller 141 as a result of being adsorbed by a magnetic force. Specifically, a magnetic force (line of magnetic force) generated from the magnetic pole S3 of the magnet roller 141B reaches the outer peripheral surface of the rotating sleeve 141A, whereby the portion 4*a* of the developer 4 is held and supplied while forming a carrier-chain magnetic brush in which the magnetic carrier particles to which the charged non-magnetic toner adheres are connected to one another in the form of a chain.

Subsequently, as illustrated in FIG. 6, in the course of transportation by the rotation of the sleeve 141A, a portion of the two-component developer 4*a* held by the sleeve 141A is blocked by the passage control plate 145 and a portion of the two-component developer 4*a* is allowed to pass. Specifically, the developer 4*a* reaching the passage control plate 145 forms a magnetic brush and is in a standing state while receiving a magnetic force of the magnetic pole N1 for control assistance. Thus, a portion of the developer 4*a* is blocked by the passage control plate 145, and a large portion of the developer 4*a* is returned to the storage chamber 140*b* side. On the other hand, when the remaining developer 4*b* passes through the gap between the sleeve 141A and the passage control plate 145, the passage of the developer 4*b* is controlled so that the developer 4*b* has a substantially uniform layer thickness (so that a constant amount of the developer 4*b* is transported).

Subsequently, as illustrated in FIG. 6, the developer 4*b* after being controlled by the passage control plate 145 reaches and then passes through the closest portion 147 between the first developing roller 141 and the second developing roller 142. In this case, when the developer 4*b* passes through a position slightly front of the closest portion 147, the developer 4*b* is transferred so that a portion (4*d*) of the developer 4*b* is moved from the first developing roller 141 to the second developing roller 142 along a transfer path formed of a magnetic brush formed by the first transfer magnetic pole S2 and the second transfer magnetic pole N20, which are respectively arranged in the first developing roller 141 and the second developing roller 142 so as to face each other. As a result, as illustrated in FIG. 6, the developer 4*b* is substantially divided into two parts and distributed onto the first developing roller 141 and the second developing roller 142 (developer 4*c* and developer 4*d*).

In this case, the developer 4*c* distributed onto the first developing roller 141 is transported while being held on the outer peripheral surface of the sleeve 141A rotating in the direction indicated by the arrow C by a magnetic force of the transport pole N2. When the developer 4*c* passes through the downstream developing region E2 of the photoconductor drum 11, the developer 4*c* receives a magnetic force of the development pole S1 and receives an action by the developing electric field due to the developing voltage. Accordingly, the toner in the magnetic brush of the developer 4*c* is reciprocated between the outer peripheral surface of the photoconductor drum 11 and the outer peripheral surface of the sleeve 141A and adheres to a latent image portion passing through the downstream developing region E2. Thus, the latent image portion is again developed subsequent to the developing step in the upstream developing region E1.

Regarding a developer 4*e* after passing through the downstream developing region E2, almost all the developer 4*e*, i.e., a developer 4*f* receives an action of a repulsive magnetic force formed between the magnetic poles S4 and S3 serving as separation poles, and is separated from the outer peripheral surface of the sleeve 141A and naturally falls to be returned to the storage chamber 140*b* of the housing 140.

The developer 4*d* transferred and distributed onto the second developing roller 142 is transported while being held on the outer peripheral surface of the sleeve 142A rotating in the direction indicated by the arrow D by a magnetic force of the transport pole S10. When the developer 4*d* passes through the upstream developing region E1 of the photoconductor drum 11, the developer 4*d* receives a magnetic force of the development pole N10 and receives an action by the developing electric field due to the developing voltage. Accordingly, the toner in the magnetic brush of the developer 4*d* is reciprocated between the outer peripheral surface of the photoconductor drum 11 and the outer peripheral surface of the sleeve 142A and adheres to a latent image portion passing through the upstream developing region E1, thereby developing the latent image portion.

A developer 4*g* after passing through the upstream developing region E1 is transported while being held on the outer peripheral surface of the sleeve 142A rotating in the direction indicated by the arrow D by a magnetic force of the transport poles S20 and N30, and is then separated from the outer peripheral surface of the sleeve 142A by a repulsive magnetic force formed between the magnetic poles S30 and S40 serving as separation poles. A developer 4*h* separated at this time is collected so as to be received by the recovery guiding plate 146, and is finally returned so as to be guided into the storage chamber 140*b* of the housing 140.

The development by the developing device 14 is performed as described above.

In the developing device 14, during the operation of image formation by the image forming apparatus 1, since the developing rollers 141 and 142 of the developing device 14 are rotated at a relatively high speed, air outside the housing 140 is taken into the inside (storage chamber 140*b*) of the housing 140 through the opening 140*a*. As a result, the inner pressure of the housing 140 is maintained to be high.

In this developing device 14, when the operation of image formation is finished and stopped, the rotation of the developing rollers 141 and 142 is also stopped. Therefore, air substantially compressed in the housing 140 is released to the outside of the housing 140 through the opening 140*a*. The air released at this time preferentially passes through a portion where the gap is relatively large and moves to the outside of the housing 140.

Figure 16:
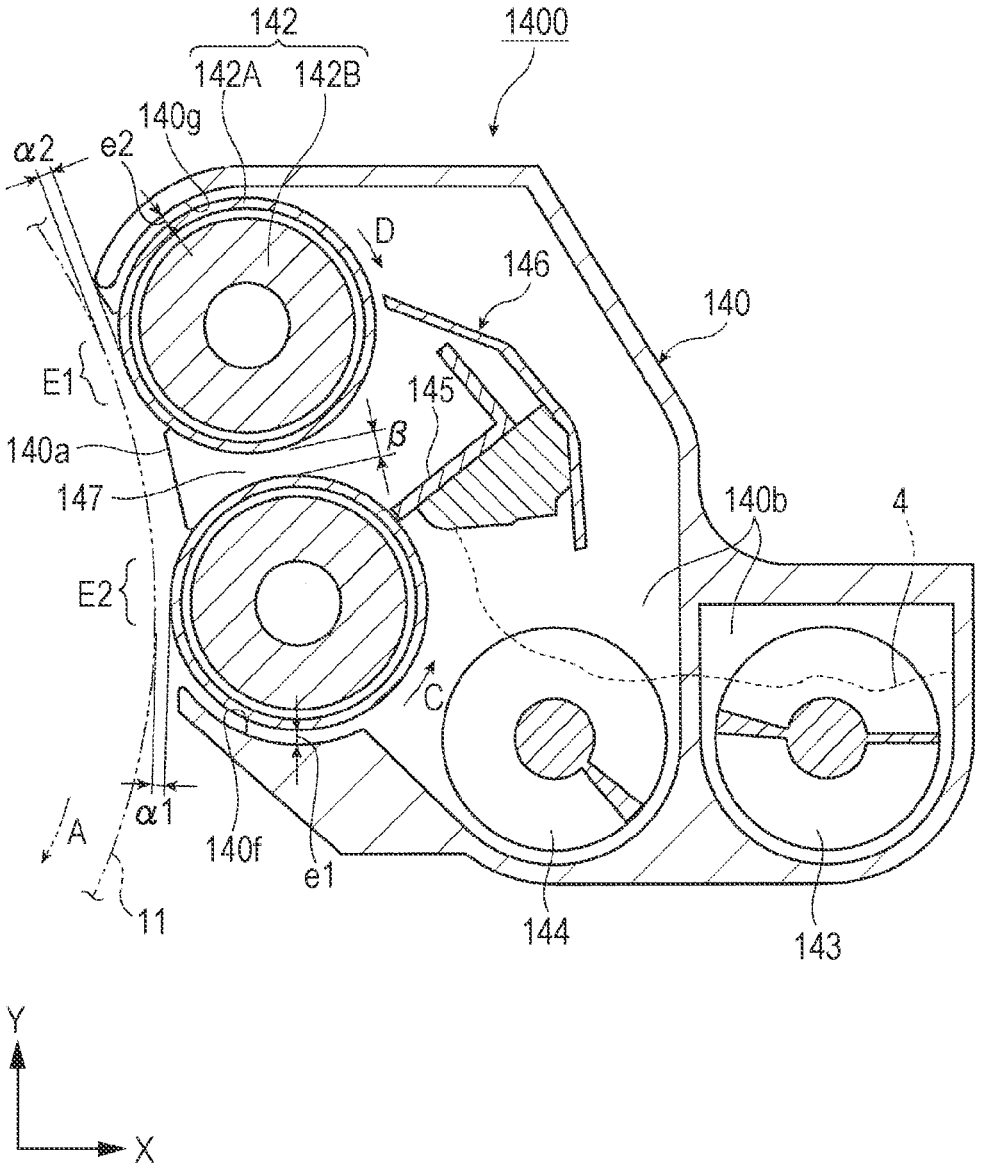
FIG. 16 RELATED ART
FIG. 16 is a cross-sectional view illustrating the structure of a developing device in the related art.

Here, an existing developing device 1400 will be described. As exemplified in FIG. 16, in the existing developing device 1400, a minimum distance e1 between an inner surface portion 140*f* extending to an opening 140*a* of a housing 140 and (a sleeve 141A of) a first developing roller 141 arranged close to the inner surface portion 140*f* and a minimum distance e2 between an inner surface portion 140*g* extending to the opening 140*a* of the housing 140 and (a sleeve 142A of) a second developing roller 142 arranged close to the inner surface portion 140*g* are each set to a value smaller than a minimum distance (gap) β between the two developing rollers 141 and 142 ($e1<\beta$, $e2<\beta$).

Accordingly, when the operation of image formation is finished and the rotation of the developing rollers 141 and 142 are also stopped, (compressed or high-pressure) air in the housing 140 preferentially passes through a portion between the developing rollers 141 and 142 (a closest portion 147) where the space (gap β) is relatively large rather than the gaps between the inner surface portion 140*f* extending to the opening 140*a* of the housing 140 and the first developing roller 141 and between the inner surface portion 140*g* extending to the opening 140*a* of the housing 140 and the second developing roller 142, and moves toward the photoconductor drum 11. Thus, the air temporarily stays in a substantially triangular cross section space formed between the two developing rollers 141 and 142 and the photoconductor drum 11. The air passes from the opening 140*a* through gaps between the photoconductor drum 11 and each end of the developing rollers 141 and 142, and is finally discharged so as to leak to the outside of the housing 140.

Figure 17:
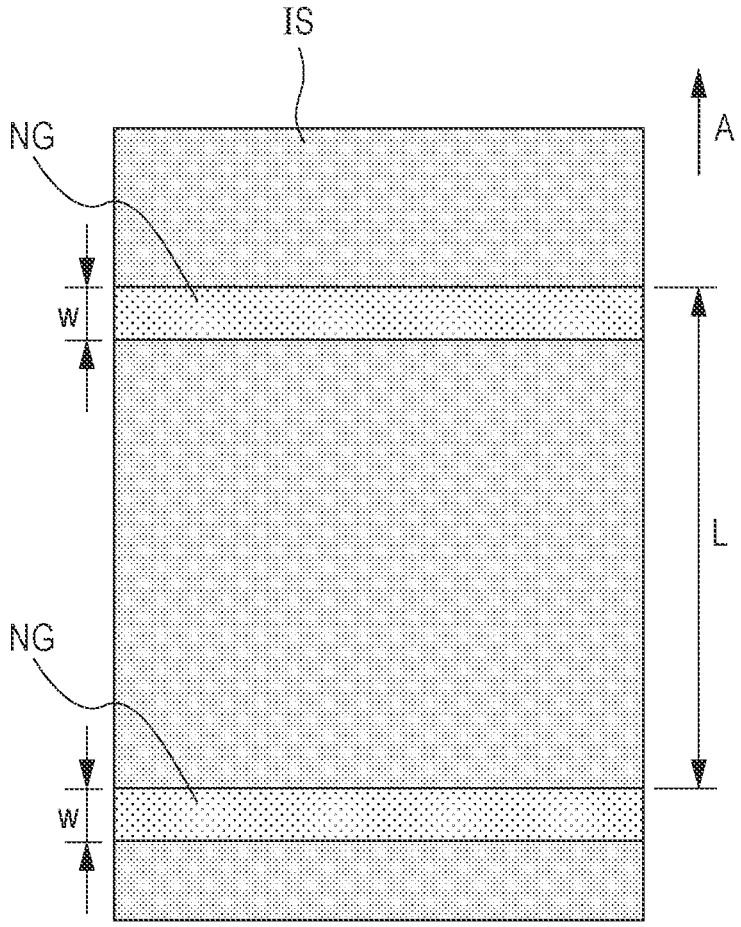
FIG. 17 RELATED ART
FIG. 17 is a view for explaining a problem that occurs in a developing device in the related art.

In an image forming apparatus including the existing developing device 1400, the following problem occurs particularly in the case where a photoconductor (photoconductor drum 11), which includes a top surface layer (protective layer 116) having a cross-linked structure formed by dehydration condensation of a charge-transporting monomer having a hydroxyl group, and a developer, as a developer 4 that exhibits magnetism, containing a toner obtained by dispersing fine particles that form the toner in a solvent containing water, causing aggregation, and conducting heating, are used. For example, when the image forming apparatus is not used for several days and image formation is then performed, as illustrated in FIG. 17, regions NG where the image density is decreased are generated on an output image IS in strip shapes. In the regions NG where the image density is decreased, the length (width) w in the rotation direction A of the photoconductor drum 11 substantially corresponds to the distance between the two developing regions E1 and E2 of the photoconductor drum 11 facing the two developing rollers 141 and 142. In addition, the regions NG where the image density is decreased are generated at substantially the same intervals as a pitch L which is a perimeter of the outer peripheral surface of the photoconductor drum 11.

The reason for the generation of the regions where the image density is decreased is believed to be as follows. First, air that is moved by the above-described discharge presses the developer 4 (a developer 4*c* between the first developing roller 141 and the photoconductor drum 11 and a developer 4*d* between the second developing roller 142 and the photoconductor drum 1) toward the outer peripheral surface of the photoconductor drum 11. A water component remaining in the toner of the developer 4 adsorbs onto an unreacted hydroxyl group in the protective layer 116, which is the top surface layer of the photoconductor drum 11, whereby the sensitivity of the photoconductor drum 11 (photosensitive layer) changes. The space formed between the two developing rollers 141 and 142 and the photoconductor drum 11 is a space that is locally isolated from the air outside the housing 140. The developer 4 is present in the space while contacting the outer peripheral surface of the photoconductor drum 11. It is believed that, as a result, the portion of the space where the developer 4 is present remains on the photoconductor drum 11 after the image forming apparatus has been left standing for a long period as a record of a portion where the sensitivity is decreased, and the portion where the sensitivity is decreased is reflected in the output image as the strip-shaped regions where the density is decreased. Each of a gap between the photoconductor drum 11 and the first developing roller 141 and a gap between the photoconductor drum 11 and the second developing roller 142 (gap portions in the developing regions E1 and E2) is filled with the developer 4 because the developer 4 (4*j* and 4*k* in FIG. 7) held on each of the developing rollers is present in the form of a carrier chain with a magnetic force of the corresponding development pole.

Figure 7:
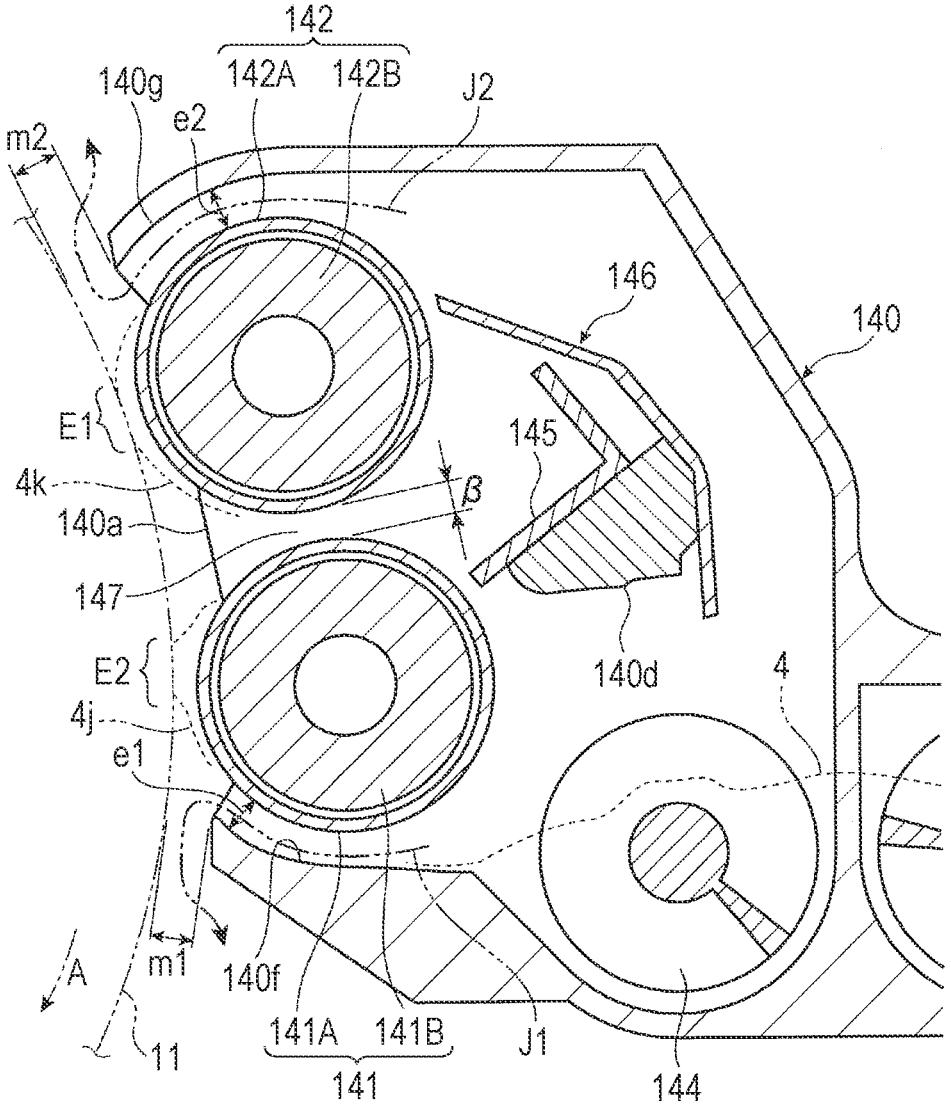
FIG. 7 is an enlarged view illustrating a stopped state after an operation of the developing device illustrated in FIG. 3 is finished.

In contrast, in the developing device 14 of the image forming apparatus 1 according to the first exemplary embodiment, when the operation of image formation is finished and the rotation of the developing rollers 141 and 142 is stopped, compressed or high-pressure air in the housing 140 moves in the directions indicated by the two-dot chain line arrows J1 and J2 in FIG. 7. Specifically, the air preferentially passes through a gap (minimum distance e1) between the inner surface portion 140*f* extending to the opening 140*a* of the housing 140 and the first developing roller 141 and a gap (minimum distance e2) between the inner surface portion 140*g* extending to the opening 140*a* of the housing 140 and the second developing roller 142, each of which is equal to or larger than the gap (minimum distance β) between the developing rollers 141 and 142, and moves towards the photoconductor drum 11. Subsequently, the air moves so as to pass through the gaps (minimum distances m1 and m2) between the housing 140 and the outer peripheral surface of the photoconductor drum 11, each of which is also equal to or larger than the gap (minimum distance β) between the developing rollers 141 and 142, and is discharged to the outside of the housing 140. Even in the case where each of the gap e1 between the inner surface portion 140*f* of the housing 140 and the first developing roller 141 and the gap e2 between the inner surface portion 140*g* of the housing 140 and the second developing roller 142 is equal to the distance β between the developing rollers 141 and 142, the air preferentially passes the gap between the inner surface portion 140*f* of the housing 140 and the first developing roller 141 and the gap between the inner surface portion 140*g* of the housing 140 and the second developing roller 142 rather than the gap between the developing rollers 141 and 142. It is believed that this is because the developer 4 is present between the developing rollers 141 and 142 in the form of a carrier chain, and thus the gap between the developing rollers 141 and 142 is substantially in a narrower state.

As a result, in this developing device 14, it is possible to suppress a phenomenon in which compressed or high-pressure air in the housing 140 flows into and stays in the substantially triangular cross section space formed between the two developing rollers 141 and 142 and the photoconductor drum 11. Accordingly, it is also possible to suppress a change in the sensitivity of the photoconductor drum 11 (photosensitive layer) due to the adsorption of a water component remaining in the toner of the developer 4 onto an unreacted hydroxyl group in the protective layer 116, which is the top surface layer of the photoconductor drum 11. Therefore, in the image forming apparatus 1 including this developing device 14, even when image formation is restarted after the image forming apparatus 1 is left standing for a long period, it is possible to suppress the generation of the regions (NG) where the image density is decreased in strip shapes on an image output at that time.

Second Exemplary Embodiment

Figure 8:
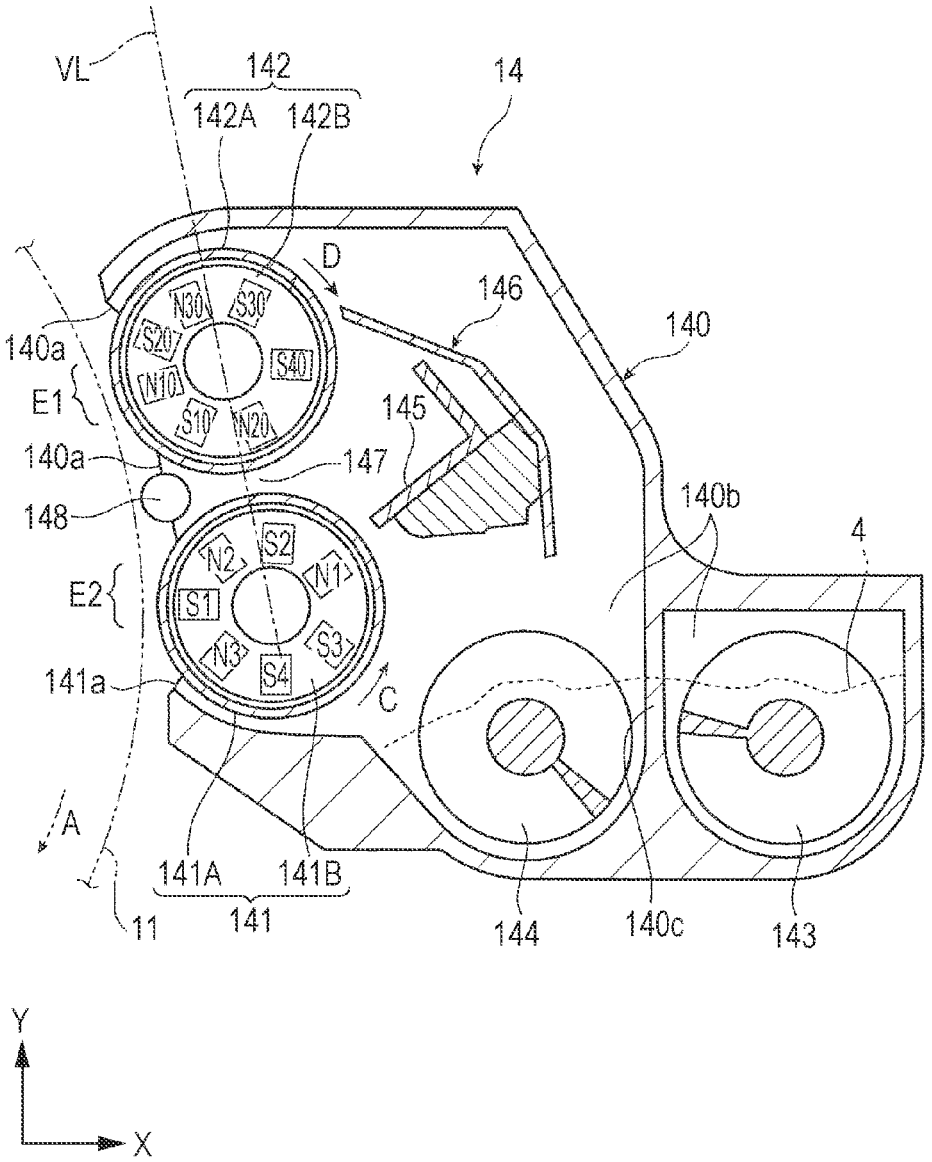
FIG. 8 is a cross-sectional view illustrating the structure of a developing device according to a second exemplary embodiment.
Figure 9:
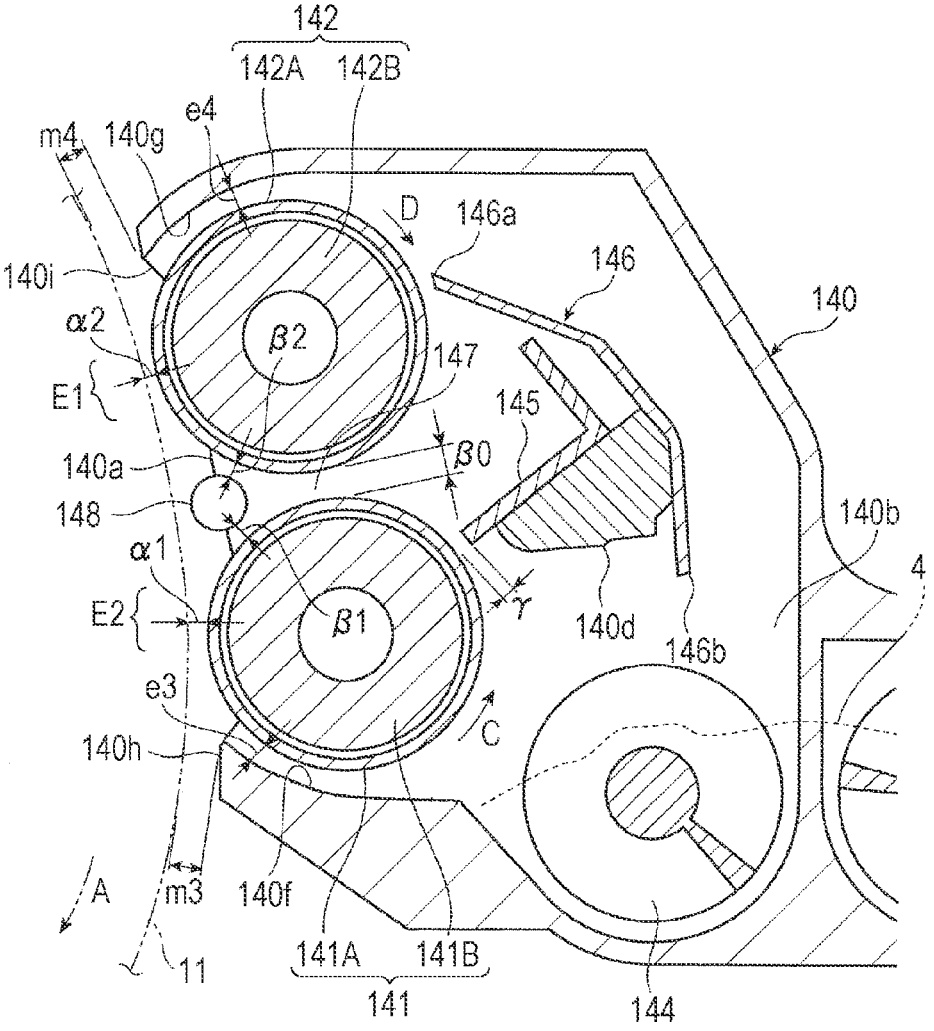
FIG. 9 is an enlarged cross-sectional view illustrating the detailed structure of the developing device illustrated in FIG. 8.

FIGS. 8 and 9 each illustrate a developing device in an image forming apparatus according to a second exemplary embodiment. FIG. 8 is a schematic view illustrating an overall structure of the developing device, and FIG. 9 is an enlarged view illustrating a part of the developing device.

Developing devices 14 (s1, s2, Y, M, C, and K) in the second exemplary embodiment each have the same structure as the developing device 14 (FIG. 3 etc.) in the first exemplary embodiment except that a gap-reducing member 148 is additionally provided at a position between developing rollers 141 and 142 in an opening 140*a* of a housing 140 so as to reduce a space, and some of setting values of minimum gaps are changed in accordance with this addition.

The gap-reducing member 148 is provided at a position between the two developing rollers 141 and 142 and on the photoconductor drum 11 side without contacting the outer peripheral surfaces of the developing rollers 141 and 142. The gap-reducing member 148 is, for example, a columnar member composed of a (nonmagnetic) material such as aluminum or stainless steel. Both ends of the gap-reducing member 148 are fixed to side wall portions of the housing 140 so that a gap between the outer peripheral surface of the column and the first developing roller 141 is a gap β1 and a gap between the outer peripheral surface of the column and the second developing roller 142 is a gap β2. Each of the gaps β1 and β2 is smaller than a gap (β0) (closest portion 147) between the two developing rollers 141 and 142.

As illustrated in FIG. 9 etc., each of the developing devices 14 (s1, s2, Y, M, C, and K), regarding a minimum distance e3 between an inner surface portion 140*f* extending to the opening 140*a* of the housing 140 and (a sleeve 141A of) the first developing roller 141 arranged close to the inner surface portion 140*f*, and a minimum distance e4 between an inner surface portion 140*g* extending to the opening 140*a* of the housing 140 and (a sleeve 142A of) the second developing roller 142 arranged close to the inner surface portion 140*g*, each of the minimum distances e3 and e4 is set to a value equal to or larger than a minimum distance β1 between the gap-reducing member 148 and the first developing roller 141 close to the gap-reducing member 148 and β2 between the gap-reducing member 148 and the second developing roller 142 close to the gap-reducing member 148 (e3≥β1 and β2, e4≥β1 and β2). In addition, in each of the developing devices 14, regarding minimum distances m3 and m4 between the housing 140 and the outer peripheral surface of the photoconductor drum 11, each of the minimum distances m3 and m4 is set to a value equal to or larger than the minimum distance β1 between the gap-reducing member 148 and the first developing roller 141 close to the gap-reducing member 148 and P2 between the gap-reducing member 148 and the second developing roller 142 close to the gap-reducing member 148 (m3≥β1 and β2, m4≥β1 and β2). The minimum distance β0 between the two developing rollers 141 and 142 may be set to be the same as or different from the minimum distance β in the developing device 14 of the first exemplary embodiment. However, in any case, a minimum distance β0 is set to be smaller than each of the development gaps α1 and α2 (β0<α1, β0<α2).

Figure 10:
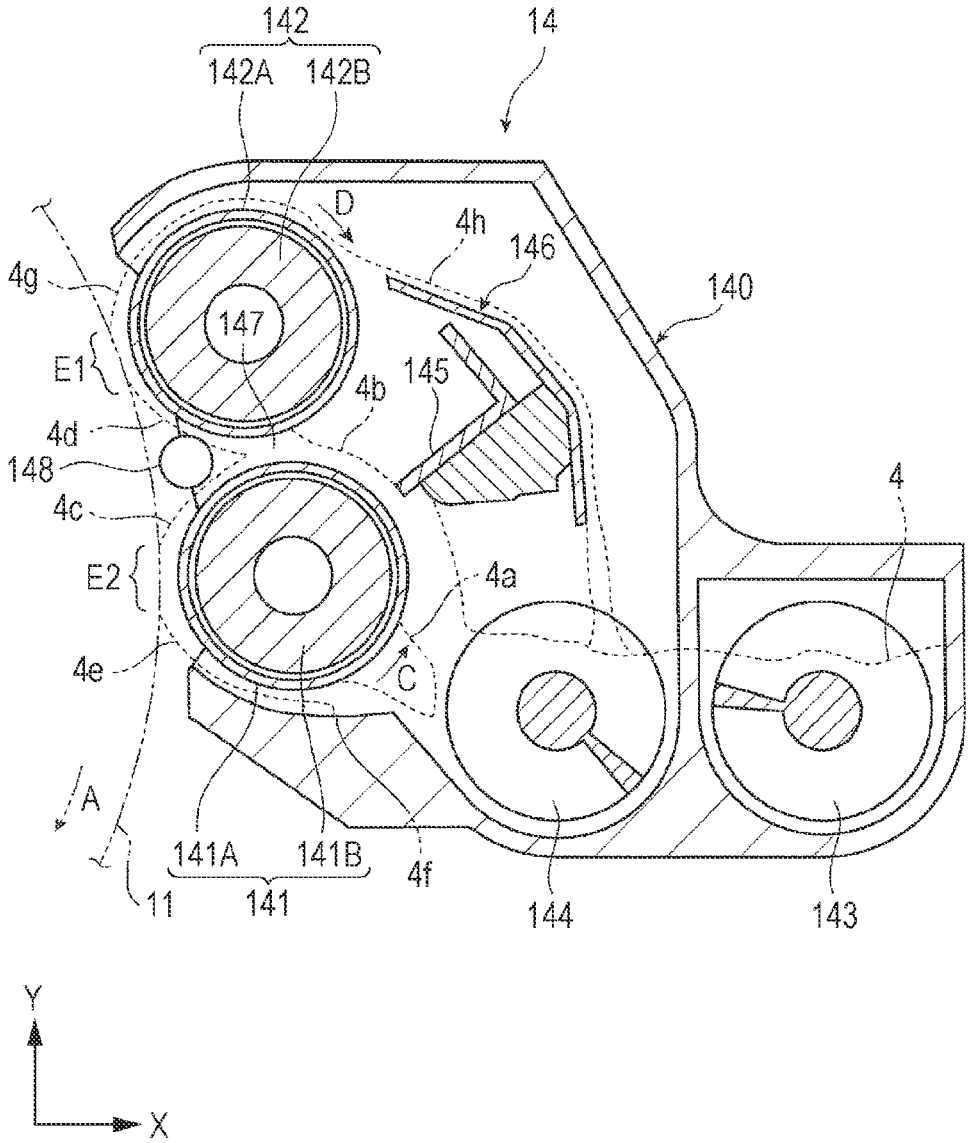
FIG. 10 is a view illustrating an operating state of the developing device illustrated in FIG. 8.

Furthermore, in the developing device 14, as illustrated in FIG. 8, magnetic poles N2 and S10 that respectively generate a magnetic force for causing the developer 4 (4*c* and 4*d*) to form a carrier chain on the sleeves 141A and 142A are respectively arranged at positions of magnet rollers 141B and 142B of the developing rollers 141 and 142 facing the gap-reducing member 148. The magnetic poles N2 and S10 each generates a magnetic force to the extent that an upper end portion of the developer 4 forming a carrier chain is in contact with the outer peripheral surface of the gap-reducing member 148 (FIG. 10).

The developing device 14 is basically operated as in the case of the developing device 14 in the first exemplary embodiment, and develops an electrostatic latent image on the photoconductor drum 11. In this developing device 14, the space (closest portion 147) between the two developing rollers 141 and 142 is reduced by arranging the gap-reducing member 148. As a result, gaps (β1 and β2) each of which is smaller than a minimum distance β0 between the developing rollers 141 and 142 are respectively formed between the gap-reducing member 148 and the first developing roller 141 and between the gap-reducing member 148 and the second developing roller 142.

Figure 11:
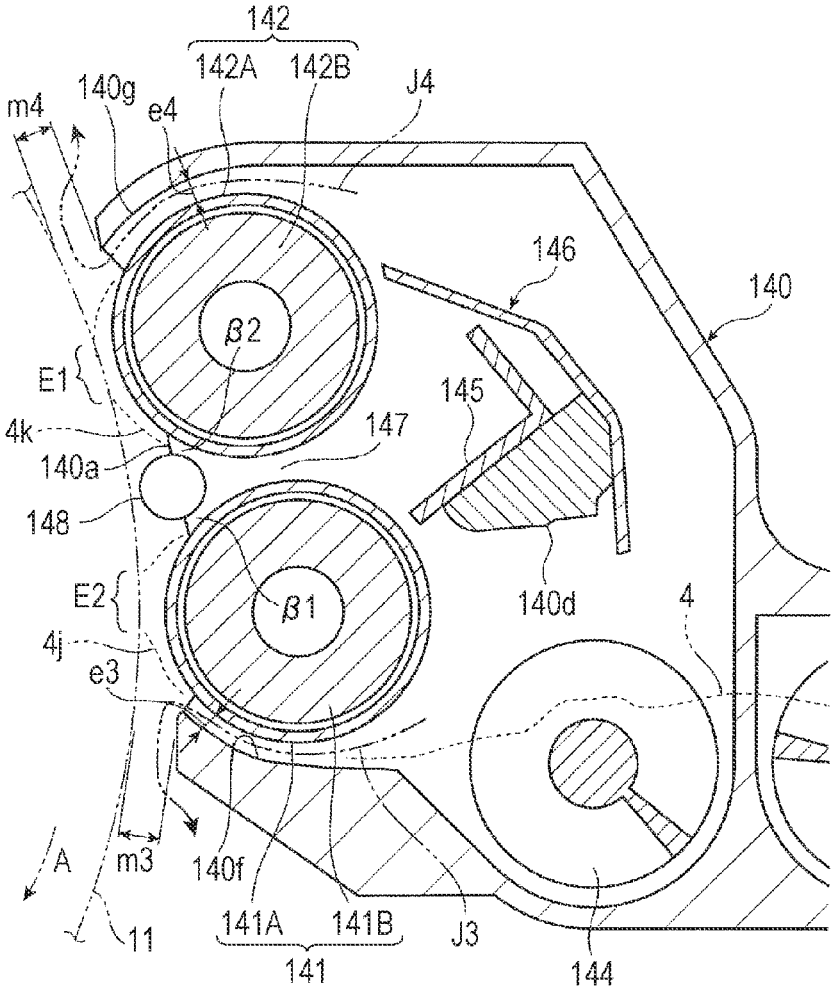
FIG. 11 is an enlarged view illustrating a stopped state after an operation of the developing device illustrated in FIG. 8 is finished.

In the developing device 14, when the operation of image formation by the image forming apparatus 1 is finished and the rotation of the developing rollers 141 and 142 is stopped, compressed or high-pressure air in the housing 140 moves in the directions indicated by the two-dot chain line arrows J3 and J4 in FIG. 11. Specifically, the air preferentially passes through a gap (minimum distance e3) between the inner surface portion 140*f* extending to the opening 140*a* of the housing 140 and the first developing roller 141 and a gap (minimum distance e4) between the inner surface portion 140*g* extending to the opening 140*a* of the housing 140 and the second developing roller 142, each of which is larger than the gap (minimum distance β1) between the gap-reducing member 148 and the developing roller 141 and the gap (minimum distance β2) between the gap-reducing member 148 and the developing roller 142, and moves towards the photoconductor drum 11. Subsequently, the air moves so as to pass through the gaps (minimum distances m3 and m4) between the housing 140 and the outer peripheral surface of the photoconductor drum 11, each of which is also larger than the gap (minimum distance β1) between the gap-reducing member 148 and the developing roller 141 and the gap (minimum distance β2) between the gap-reducing member 148 and the developing roller 142, and is discharged to the outside of the housing 140.

As a result, in this developing device 14, it is possible to significantly suppress a phenomenon in which compressed or high-pressure air in the housing 140 flows into and stays in the substantially triangular cross section space formed between the two developing rollers 141 and 142 and the photoconductor drum 11. Accordingly, in this developing device 14, it is also possible to further suppress a change in the sensitivity of the photoconductor drum 11 (photosensitive layer) due to the adsorption of a water component remaining in the toner of the developer 4 onto an unreacted hydroxyl group in the protective layer 116, which is the top surface layer of the photoconductor drum 11. Therefore, in the image forming apparatus 1 including this developing device 14, even when image formation is restarted after the image forming apparatus 1 is left standing for a long period, it is possible to suppress the generation of the regions (NG) where the image density is decreased in strip shapes on an image output at that time.

Furthermore, in this developing device 14, each of the minimum distance β1 between the gap-reducing member 148 and the developing roller 141 and the minimum distance β2 between the gap-reducing member 148 and the developing roller 142 is smaller than the minimum distance β0 between the developing rollers 141 and 142. Accordingly, the inflow of air into the substantially triangular cross section space is suppressed, as compared with the developing device 14 of the first exemplary embodiment. In addition, the gaps between the gap-reducing member 148 and the developing roller 141 and between the gap-reducing member 148 and the developing roller 142 are each filled with the developer 4 forming a carrier chain with a magnetic force due to the magnetic poles N2 and S10 arranged at positions of the developing rollers 141 and 142, respectively, that face the gap-reducing member 148. This structure may also suppress the inflow of air into the substantially triangular cross section space, as compared with the developing device 14 of the first exemplary embodiment. As a result, in the image forming apparatus 1 including this developing device 14, it is possible to more reliably suppress a phenomenon in which the regions where the image density is decreased are generated in strip shapes on an image.

In this developing device 14, each of the minimum distance β1 between the gap-reducing member 148 and the developing roller 141 and the minimum distance β2 between the gap-reducing member 148 and the developing roller 142 is smaller than the minimum distance β0 between the developing rollers 141 and 142. Therefore, the minimum distance e3 between the inner surface portion 140*f* extending to the opening 140*a* of the housing 140 and the first developing roller 141 and the minimum distance e4 between the inner surface portion 140*g* extending to the opening 140*a* of the housing 140 and the second developing roller 142 may be made smaller than the minimum distance e1 and the minimum distance e2 in the case of the developing device 14 in the first exemplary embodiment. Specifically, the housing 140 has a shape in which the gap between the inner surface portion 140*f* extending to the opening 140*a* and the first developing roller 141 and the gap between the inner surface portion 140*g* extending to the opening 140*a* and the second developing roller 142 are narrower than those in the developing device 14 in the first exemplary embodiment. As a result, in the developing device 14, during the operation of image formation and at the time of stopping of the operation, it is possible to suppress the leakage of a part of the developer 4 (for example, a toner in a floating state) in the housing 140 to the outside of the housing 140 through the gaps between the inner surface portion 140*f* of the housing 140 and the first developing roller 141 and between the inner surface portion 140*g* of the housing 140 and the second developing roller 142, as compared with the case of the developing device 14 in the first exemplary embodiment.

[Evaluation Tests]

In evaluation tests described in detail below, first, photoconductor drums 11 and a developer (toner) 4 having the structures below and used in the test are prepared.

The following two photoconductor drums A and B are prepared as the photoconductor drums 11.

Preparation of Photoconductor Drum A

First, a cylindrical aluminum base (diameter: 84 mm, length: 347 mm, wall thickness: 1 mm) is prepared as a conductive support 110. A coating solution for forming an underlayer is prepared as described below. The coating solution is applied onto the aluminum base by dipping, and then dried and cured at 170° C. for 40 minutes to form an underlayer 112 having a thickness of 21 μm.

The coating solution for forming an underlayer is prepared as follows. First, 100 parts of zinc oxide (average particle diameter: 70 nm, produced by TAYCA CORPORATION, specific surface area: 15 $m^2/g$) is mixed with 500 parts of toluene under stirring, 1.25 parts of a silane coupling agent (KBM603, produced by Shin-Etsu Chemical Co., Ltd.) is added thereto, and the resulting mixture is stirred for two hours. Subsequently, toluene is distilled off by distillation under reduced pressure, and baking is then conducted at 120° C. for three hours. Thus, a surface treatment is conducted on the zinc oxide using the silane coupling agent.

Next, 100 parts of the surface treated zinc oxide is mixed with 500 parts of tetrahydrofuran under stirring. A solution prepared by dissolving 1 part of alizarin in 50 parts of tetrahydrofuran is added to the mixture, and the resulting mixture is stirred at 50° C. for five hours. Subsequently, the zinc oxide to which alizarin is applied is filtered off by filtration under reduced pressure, and further dried under reduced pressure at 60° C. to obtain a zinc oxide pigment having alizarin applied thereto.

Next, 60 parts of the zinc oxide pigment having alizarin applied thereto, 13.5 parts of a curing agent (blocked isocyanate, SUMIDUR 3175, produced by Sumitomo Bayer Urethane Co., Ltd.), and 15 parts of a butyral resin (S-LEC BM-1, produced by Sekisui Chemical Co., Ltd.) are dissolved in 85 parts of methyl ethyl ketone to prepare a solution. Subsequently, 38 parts of this solution is mixed with 25 parts of methyl ethyl ketone, and the resulting mixture is dispersed with a sand mill using glass beads having a diameter of 1 mm for two hours to prepare a dispersion liquid.

Next, 0.005 parts of dioctyl tin dilaurate functioning as a catalyst and 40 parts of silicone resin particles (TOSPEARL 145, produced by GE Toshiba Silicone Co., Ltd.) are added to the dispersion liquid to prepare a coating solution for forming an underlayer.

Subsequently, a coating solution for forming a charge generating layer is prepared as described below. The coating solution is applied onto the surface of the underlayer by dipping, and then dried by heating at 100° C. for 10 minutes to form a charge generating layer 113 having a thickness of 0.2 μm.

The coating solution for forming a charge generating layer is prepared as follows. One part of a chlorogallium phthalocyanine crystal having strong diffraction peaks at 7.4°, 16.6°, 25.5°, and 28.3° of Bragg angles (2θ±0.2°) in an X-ray diffraction spectrum and serving as a charge generating substance, and 1 part of a polyvinyl butyral resin (S-LEC BM-S, produced by Sekisui Chemical Co., Ltd.) are added to 100 parts of butyl acetate. The resulting mixture is treated with a paint shaker together with glass beads for one hour to disperse the chlorogallium phthalocyanine crystal.

Subsequently, a coating solution for forming a charge transporting layer is prepared as described below. The coating solution is applied onto the surface of the charge generating layer by dipping, and then dried by heating at 135° C. for 35 minutes to form a charge transporting layer 114 having a thickness of 22 μm.

The coating solution for forming a charge transporting layer is prepared by dissolving 2 parts of a charge transporting material A1 (first charge transporting material) represented by the formula below and 3 parts of a polymer compound (viscosity-average molecular weight: 39,000) represented by structural formula 1 below in 10 parts of tetrahydrofuran and 5 parts of toluene.

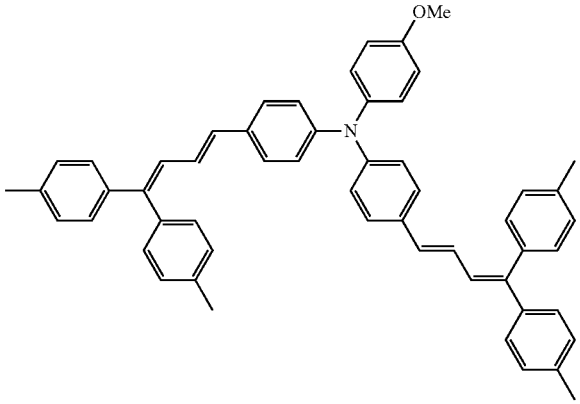

Charge Transporting Material A1

Structural formula 1

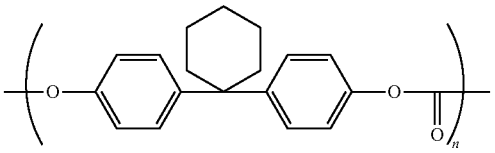

Subsequently, a coating solution for forming a surface protective layer is prepared as described below. The coating solution is applied onto the surface of the charge transporting layer by dipping, and dried at 155° C. for 40 minutes to form a surface protective layer 116 having a thickness of 6 μm.

The coating solution for forming a surface protective layer is prepared as follows. First, 94 parts of a charge transporting material represented by structural formula A below and 1 part of a benzoguanamine resin are added to 220 parts of cyclopentanone, and sufficiently dissolved and mixed. Next, 0.9 parts of dimethylpolysiloxane (Glanol 450, produced by Kyoeisha Chemical Co., Ltd.) and 0.1 parts of NACURE5225 (produced by King Industries, Inc.) are added to the mixture.

Structural formula A

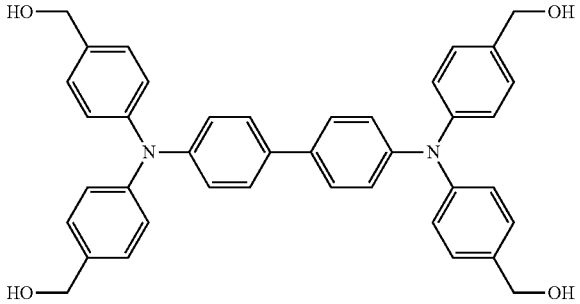

A photoconductor obtained through the above steps and having a layer structure illustrated in FIG. 5A is used as a photoconductor drum A.

Preparation of Photoconductor Drum B

A photoconductor drum B is prepared as in the photoconductor drum A except that the coating solution for forming a surface protective layer is changed to a coating solution prepared as described below.

The coating solution for forming a surface protective layer is prepared as follows. First, 94 parts of the charge transporting material represented by structural formula A and 1 part of a benzoguanamine resin are added to 220 parts of cyclopentanone, and sufficiently dissolved and mixed. A suspension of tetrafluoroethylene resin particles described below is added to the resulting mixture, and mixed under stirring. A dispersion treatment of the resulting mixture is repeated 30 times at an elevated pressure of 700 kgf/cm$^2$ using a high-pressure homogenizer (YSNM-1500AR, produced by Yoshida Kikai Co., Ltd.,) equipped with a penetrating chamber having a minute flow path. Subsequently, as in the case with the coating solution for forming a surface protective layer of the photoconductor drum A, 0.9 parts of dimethylpolysiloxane and 0.1 parts of NACURE5225 are added to the mixture. Thus, a coating solution for forming a surface protective layer is prepared.

The suspension of tetrafluoroethylene resin particles is prepared by sufficiently mixing 4 parts of Lubron L-2 (produced by Daikin Industries, Ltd.) as the tetrafluoroethylene resin particles and 0.2 parts of a fluoroalkyl group-containing copolymer (weight-average molecular weight 50,000, l:m=1:1, s=1, and n=60) having repeating units represented by structural formula 2 below with 16 parts of cyclopentanone under stirring.

Structural formula 2

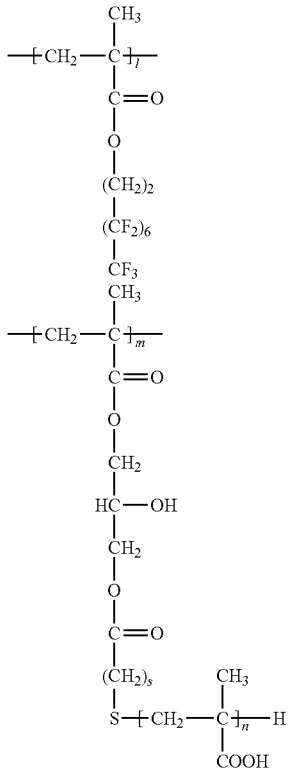

This coating solution for forming a surface protective layer is applied onto the charge transporting layer 114 in the step of producing the photoconductor drum A by a dip coating method, and dried at 155° C. for 40 minutes to form a surface protective layer 116 having a thickness of 6 μm.

The photoconductor obtained through the above steps is used as a photoconductor drum B.

Preparation of Developer

A toner 4 of the developer is produced by a wet process for producing a toner, the process including an aggregation step performed at two stages.

Preparation of Resin Dispersion Liquid 1

| | |
|---|---|
| Styrene | 370 g |
| n-Butyl acrylate | 30 g |
| Acrylic acid | 6 g |
| Dodecanethiol | 24 g |
| Carbon tetrabromide | 4 g |

The above components are mixed and dissolved. The resulting solution is added to a solution prepared by dissolving 6 g of a nonionic surfactant (Nonipol 400) and 10 g of an anionic surfactant (Neogen SC) in 550 g of ion-exchange water, and dispersed and emulsified in a flask. Next, 50 g of ion-exchange water in which 4 g of ammonium persulfate is dissolved is charged thereto while the reaction mixture is slowly mixed for 10 minutes, and the atmosphere is replaced with nitrogen. Subsequently, the flask is heated under stirring in an oil bath until the temperature of the content in the flask reaches 70° C., and emulsion polymerization is continued in this state for five hours.

Thus, an anionic resin dispersion liquid 1 containing a resin having a center diameter of 155 nm, a glass transition temperature of 59° C., and a weight-average molecular weight Mw of 12,000 is obtained.

Preparation of Resin Dispersion Liquid 2

| | |
|---|---|
| Styrene | 280 g |
| n-Butyl acrylate | 120 g |
| Acrylic acid | 8 g |

The above components are mixed and dissolved. The resulting solution is added to a solution prepared by dissolving 6 g of a nonionic surfactant (Nonipol 400) and 12 g of an anionic surfactant (Neogen SC) in 550 g of ion-exchange water, and dispersed and emulsified in a flask. Next, 50 g of ion-exchange water in which 3 g of ammonium persulfate is dissolved is charged thereto while the reaction mixture is slowly mixed for 10 minutes, and the atmosphere is replaced with nitrogen. Subsequently, the flask is heated under stirring in an oil bath until the temperature of the content in the flask reaches 70° C., and emulsion polymerization is continued in this state for five hours.

Thus, an anionic resin dispersion liquid 2 containing a resin having a center diameter of 105 nm, a glass transition temperature of 53° C., and a weight-average molecular weight Mw of 550,000 is obtained.

Preparation of Pigment Dispersion Liquid

| | |
|---|---|
| Carbon black (Mogul L, produced by Cabot Corporation) | 50 g |
| Nonionic surfactant (Nonipol 400) | 5 g |
| Ion-exchange water | 200 g |

The above components are mixed and dissolved. The resulting mixture is dispersed with a homogenizer (IKA Ultra-Turrax, produced by IKA Works Inc.) for 10 minutes to prepare a carbon black (pigment) dispersion liquid containing carbon black having a center particle diameter of 250 nm.

Preparation of Release Agent Dispersion Liquid

| | |
|---|---|
| Paraffin wax (HNP0190, melting point: 85° C., produced by Nippon Seiro Co., Ltd.) | 50 g |

-continued

| | |
|---|---|
| Cationic surfactant (Sanisol B50, produced by Kao Corporation) | 5 g |
| Ion-exchange water | 200 g |

The above components are heated to 95° C., and dispersed with a homogenizer (Ultra-Turrax T50, produced by IKA Works Inc.). The resulting mixture is then subjected to a dispersion treatment with a pressure discharge-type homogenizer to prepare a wax (release agent) dispersion liquid containing wax having a center diameter of 550 nm.

Preparation of Aggregated Particles

| | |
|---|---|
| Resin dispersion liquid 1 | 120 g |
| Resin dispersion liquid 2 | 80 g |
| Pigment dispersion liquid | 30 g |
| Release agent dispersion liquid | 40 g |
| Sanisol B50 | 1.5 g |

The above components are mixed and dispersed in a round stainless flask with the homogenizer, and the resulting mixture is then heated to 48° C. while stirring the flask in an oil bath for heating. After the temperature is maintained at 48° C. for 30 minutes, the reaction mixture was observed with an optical microscope. The formation of aggregated particles having a diameter of about 5 μm is confirmed. Next, 60 g of the resin dispersion liquid 1 is slowly added thereto. The temperature of the oil bath for heating is further increased to 50° C., and maintained for one hour. When this reaction mixture is observed with an optical microscope, the formation of aggregated particles having a diameter of about 5.7 μm is confirmed. Subsequently, 3 g of Neogen SC is added thereto, and the stainless flask is then sealed. The flask is heated to 105° C. and maintained for three hours while continuing stirring using a magnetic force seal.

The resulting mixture is cooled, filtered, and sufficiently washed with ion-exchange water to obtain aggregated fine particles. The aggregated fine particles have a particle diameter of 5.6 μm as measured with a Coulter Counter.

Next, 0.5 parts by weight of silica particles having an average particle diameter of 12 nm and 1.0 part by weight of silica particles having an average particle diameter of 40 nm are mixed with 100 parts by weight of the aggregated fine particles with a Henschel mixer to prepare a toner.

Lastly, inorganic particles functioning as a charge control agent are externally added to the toner. The resulting toner is mixed with a ferrite carrier coated with polymethylmethacrylate and having an average particle diameter of 50 μm to obtain a two-component developer 4.

In an evaluation test, a developing device 14 in the first exemplary embodiment is prepared in which the minimum distances β, e1, e2, m1, and m2 are set to the values shown in Table 1. Furthermore, an imaging device 10 including the developing device 14, the photoconductor drum A, and the developer 4 prepared as described above is prepared. An image forming apparatus in which the imaging device 10 is installed in a digital printer (C1000, produced by Fuji Xerox Co., Ltd.) is obtained. The following evaluation test 1 is conducted using this image forming apparatus.

The evaluation test 1 is performed as follows. A chart image with a coverage percentage of 10% is printed on 1,000 sheets of recording paper 5 using the image forming apparatus, and is left standing at room temperature and normal humidity for three days. Subsequently, an entire-surface halftone image (coverage density: 50%) is printed by the image forming apparatus. The generation of portions where the density is decreased (the strip-shaped regions NG where the image density is decreased, as illustrated in FIG. 17) in each image output at this time is examined. The generation of the portions where the density is decreased is visually observed and evaluated on the basis of the criteria below. The results are shown in Table 1.

A: Not generated.

B: Slightly generated but no problem in terms of practical use.

C: Significantly generated.

TABLE 1

| | Minimum distance β (mm) between developing rollers | Minimum distance e1, e2 (mm) between developing roller and housing | Minimum distance m1, m2 (mm) between photoconductor drum and housing | Evaluation result |
|---|---|---|---|---|
| Test Example 1 | 3 | 3 | 3 | B |
| Test Example 2 | 3 | 5 | 3 | B |
| Test Example 3 | 3 | 2 | 2 | C |
| Test Example 4 | 2 | 2 | 2 | B |
| Test Example 5 | 2 | 1 | 1 | C |
| Test Example 6 | 2 | 3 | 3 | B |

Referring to the results shown in Table 1, the generation of portions where the density is decreased is suppressed in the structures (Test Examples 1, 2, 4, and 6) where at least one of the minimum distance e1, e2 between the developing roller and the housing and the minimum distance m1, m2 between the photoconductor drum and the housing is set to be equal to or larger than the minimum distance β between the developing rollers.

In an evaluation test, a developing device 14 in the second exemplary embodiment is prepared in which the minimum distances β0, β1, β2, e3, e4, m3, and m4 are set to the values shown in Table 2. Furthermore, an imaging device 10 including the developing device 14, the photoconductor drum A or the photoconductor drum B, and the developer 4 prepared as described above is prepared. An image forming apparatus in which the imaging device 10 is installed in a digital printer (C1000, produced by Fuji Xerox Co., Ltd.) is obtained. The photoconductor drum A is used in Test Examples 7 to 10, and the photoconductor drum B is used in Test Example 11. The following evaluation test 2 is conducted using this image forming apparatus.

In the evaluation test 2, printing is conducted under the same conditions as the evaluation test 1. The generation of portions where the density is decreased in each image output at this time is examined as in the evaluation test 1. The results are shown in Table 2.

TABLE 2

| | Minimum distance β0 (mm) between developing rollers | Minimum distance β1, β2 (mm) between developing roller and gap-reducing member | Minimum distance e3, e4 (mm) between developing roller and housing | Minimum distance m3, m4 (mm) between photoconductor drum and housing | Evaluation result |
|---|---|---|---|---|---|
| Test Example 7 | 3 | 1 | 2 | 2 | A |
| Test Example 8 | 3 | 2 | 2 | 2 | B |

TABLE 2-continued

| | Minimum distance β0 (mm) between developing rollers | Minimum distance β1, β2 (mm) between developing roller and gap-reducing member | Minimum distance e3, e4 (mm) between developing roller and housing | Minimum distance m3, m4 (mm) between photoconductor drum and housing | Evaluation result |
|---|---|---|---|---|---|
| Test Example 9 | 4 | 1 | 2 | 2 | A |
| Test Example 10 | 4 | 2 | 1 | 1 | C |
| Test Example 11 | 4 | 2 | 2 | 2 | A |

Referring to the results shown in Table 2, the generation of portions where the density is decreased is suppressed in the cases (Test Examples 7 to 9 and 11) where both the minimum distance e3, e4 between the developing roller and the housing and the minimum distance m3, m4 between the photoconductor drum and the housing are equal to or larger than the minimum distance β1, β2 between the developing roller and the gap-reducing member. In Test Example 11, the photoconductor drum B including the surface protective layer 116, which differs from the surface protective layer 116 of the photoconductor drum A only in that tetrafluoroethylene resin particles are added, is used. In this case, a result better than the result of Test Example 8, which is prepared under the same conditions with regard to the minimum distances β1, β2, e3, e4, m3, and m4, is obtained.

Third Exemplary Embodiment

Figure 12:
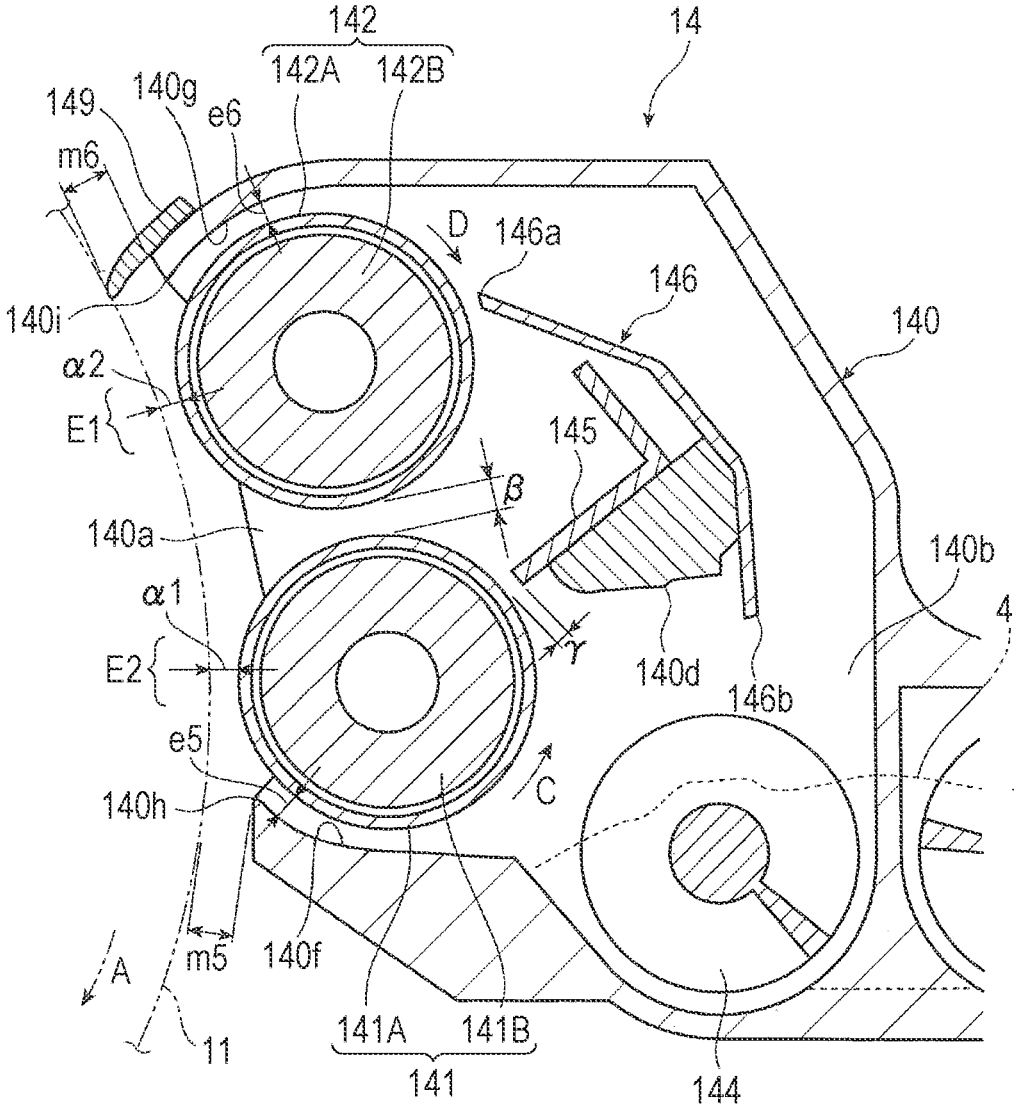
FIG. 12 is an enlarged cross-sectional view illustrating the structure of the relevant part of a developing device according to a third exemplary embodiment.

FIG. 12 is an enlarged view illustrating a part of a developing device of an image forming apparatus according to a third exemplary embodiment.

Developing devices 14 (s1, s2, Y, M, C, and K) in the third exemplary embodiment each have the same structure as the developing device 14 (FIG. 3 etc.) in the first exemplary embodiment except that a leak-preventing member 149 that prevents a developer 4 from leaking to the outside of a housing 140 is additionally provided at a position near an opening 140*a* of the housing 140, and some of setting values of minimum gaps are changed in accordance with this addition.

The leak-preventing member 149 is provided on an outer surface portion of a long side portion of the opening 140*a* of the housing 140, the long side portion being located on the upstream side in the rotation direction A of a photoconductor drum 11, so that a free end of the leak-preventing member 149 is in contact with the outer peripheral surface of the photoconductor drum 11. The leak-preventing member 149 may be, for example, a film-like member composed of polyethylene terephthalate, polyurethane, or the like. The leak-preventing member 149 is a substantially rectangular film-like member. One of long side portions of the leak-preventing member 149 is brought into contact with the outer peripheral surface of the photoconductor drum 11 as a free end, and the other long side portion opposite to the free end is fixed, as a fixed end, to the outer surface portion on the housing 140. Short side portions at both ends of the leak-preventing member 149 each have a length longer than ends (short side portions) of the opening 140*a* of the housing 140 in the longitudinal direction.

As illustrated in FIG. 12, in each of the developing devices 14 (s1, s2, Y, M, C, and K), a minimum distance e5 between a first developing roller 141 arranged on the downstream side in the rotation direction A of the photoconductor drum 11 and an inner surface portion 140*f* extending to the opening 140*a* of the housing 140 is set to a value larger than a minimum distance e6 between a second developing roller 142 arranged on the upstream side in the rotation direction A of the photoconductor drum 11 relative to the first developing roller 141 and an inner surface portion 140*g* extending to the opening 140*a* of the housing 140 (e5>e6). In addition, in each of the developing devices 14, a minimum distance e6 between the second developing roller 142 and the inner surface portion 140*g* of the housing 140 is set to be equal to or smaller than a minimum distance β between the developing rollers 141 and 142 (e6≤β).

Furthermore, in each of the developing devices 14, as in the developing device 14 in the first exemplary embodiment, at least a minimum distance e5 between (a sleeve 141A of) the first developing roller 141 and the inner surface portion 140*f* of the housing 140 is set to a value equal to or larger than the minimum distance (gap) β between the two developing rollers 141 and 142 (e5≥β). In each of the developing devices 14, at least a minimum distance m5 between the housing 140 and the outer peripheral surface of the photoconductor drum 11 is set to a value equal to or larger than the minimum distance β between the two developing rollers 141 and 142 (m5≥β). In any of these cases, the minimum distances e5 and e6 are set so as to satisfy the relationship e5>e6, as described above.

The developing device 14 is basically operated as in the case of the developing device 14 in the first exemplary embodiment, and develops an electrostatic latent image on the photoconductor drum 11.

Figure 13:
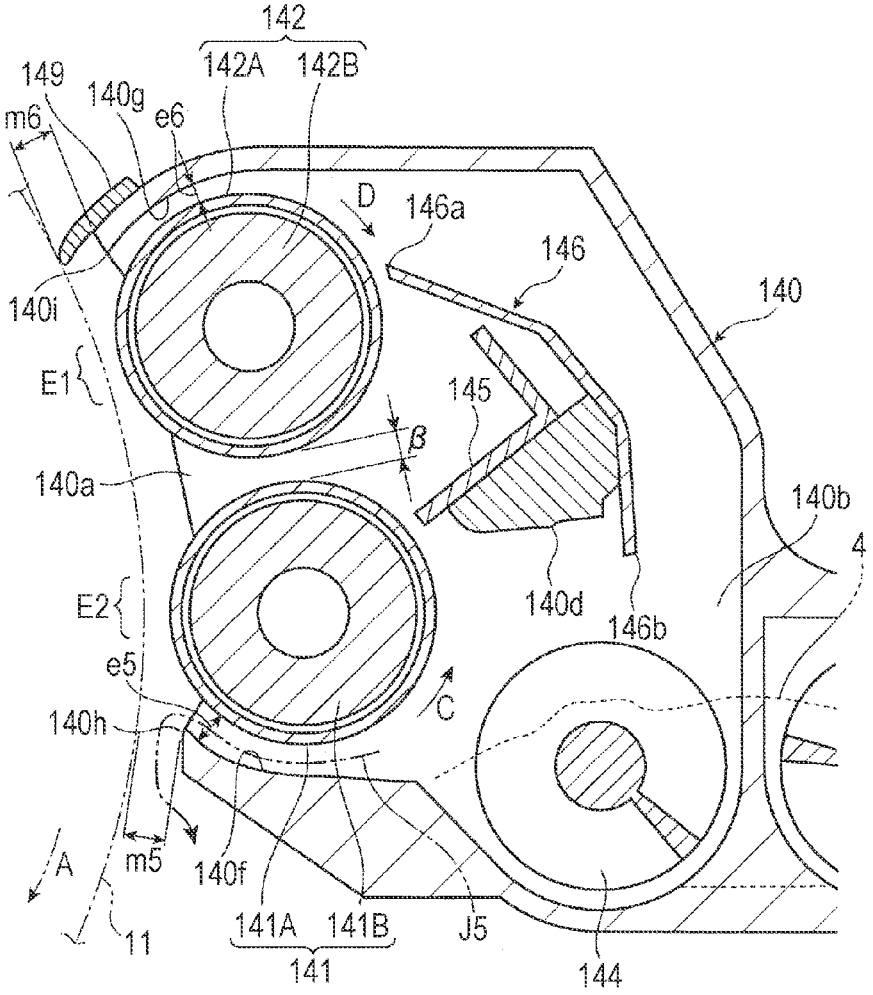
FIG. 13 is an enlarged view illustrating a stopped state after an operation of the developing device illustrated in FIG. 12 is finished.

In this developing device 14, when the operation of image formation by the image forming apparatus 1 is finished and the rotation of the developing rollers 141 and 142 is stopped, compressed or high-pressure air in the housing 140 moves in the direction indicated by the two-dot chain line arrow J5 in FIG. 13. Specifically, the air preferentially passes through a gap (minimum distance e5) between the first developing roller 141 and the inner surface portion 140*f* of the housing 140, which is larger than the gap (minimum distance β) between the developing rollers 141 and 142, and moves towards the photoconductor drum 11. Subsequently, the air moves so as to pass through the gap (minimum distance m5) between the housing 140 and the outer peripheral surface of the photoconductor drum 11, which is also larger than the gap (minimum distance β) between the developing rollers 141 and 142, and is discharged to the outside of the housing 140.

As a result, in this developing device 14, it is possible to significantly suppress a phenomenon in which compressed or high-pressure air in the housing 140 flows into and stays in the substantially triangular cross section space formed between the two developing rollers 141 and 142 and the photoconductor drum 11. Accordingly, in this developing device 14, it is also possible to further suppress a change in the sensitivity of the photoconductor drum 11 (photosensitive layer) due to the adsorption of a water component remaining in the toner of the developer 4 onto an unreacted hydroxyl group in the protective layer 116, which is the top surface layer of the photoconductor drum 11. Therefore, in the image forming apparatus 1 including this developing device 14, even when image formation is restarted after the image forming apparatus 1 is left standing for a long period, it is possible to suppress the generation of the regions (NG) where the image density is decreased in strip shapes on an image output at that time.

In this developing device 14, the leak-preventing member 149 is provided at a position (edge 140*i*) of the housing 140, the position being located on the upstream side in the rotation direction A of the photoconductor drum 11, so that a free end of the leak-preventing member 149 is in contact with the outer peripheral surface of the photoconductor drum 11. This structure prevents the developer 4 in the housing 140 from leaking through a gap (minimum distance m6) between the position (edge 140*i*) of the housing 140 and the photoconductor drum 11. In addition, in the case where the minimum distance e6 between the second developing roller 142 and the inner surface portion 140*g* of the housing 140 is set to be a value smaller than the minimum distance e5 between the first developing roller 141 and the inner surface portion 140*f* of the housing 140, at the time of stopping of the image forming operation, it is also possible to prevent air in a compressed state or the like from passing through the gap (minimum distance e6) between the second developing roller 142 and the inner surface portion 140*g* of the housing 140.

Fourth Exemplary Embodiment

Figure 14:
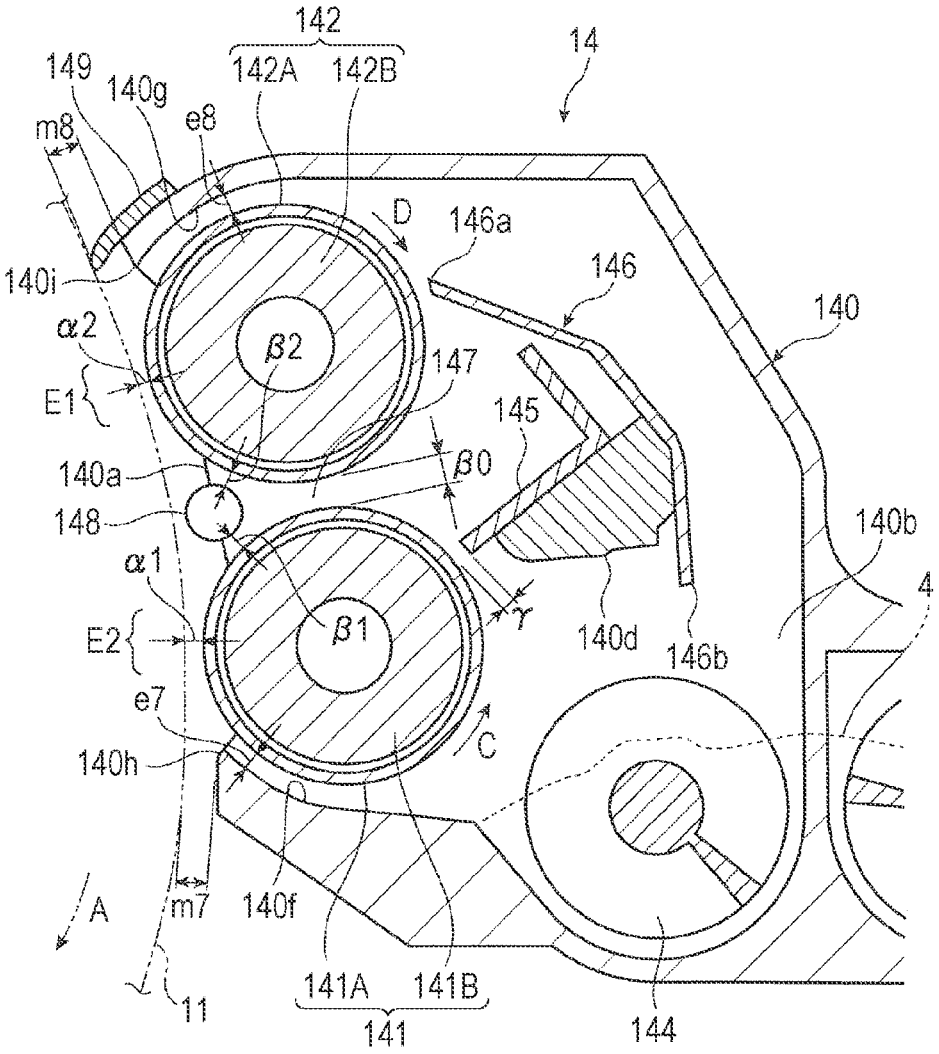
FIG. 14 is an enlarged cross-sectional view illustrating the structure of the relevant part of a developing device according to a fourth exemplary embodiment.

FIG. 14 is an enlarged view illustrating a part of a developing device of an image forming apparatus according to a fourth exemplary embodiment.

Developing devices 14 (s1, s2, Y, M, C, and K) in the fourth exemplary embodiment each have the same structure as the developing device 14 (FIG. 8 etc.) in the second exemplary embodiment except that a leak-preventing member 149 that prevents a developer 4 from leaking to the outside of a housing 140 is additionally provided at a position near an opening 140*a* of the housing 140, and some of setting values of minimum gaps are changed in accordance with this addition.

As in the developing device 14 (FIG. 12) in the third exemplary embodiment, a leak-preventing member 149 is provided on an outer surface portion of a long side portion of the opening 140*a* of the housing 140, the long side portion being located on the upstream side in the rotation direction A of a photoconductor drum 11, so that a free end of the leak-preventing member 149 is in contact with the outer peripheral surface of the photoconductor drum 11. Other conditions regarding the leak-preventing member 149 are also the same as those of the leak-preventing member 149 provided in the developing device 14 in the third exemplary embodiment.

As illustrated in FIG. 14, in each of the developing devices 14 (s1, s2, Y, M, C, and K), a minimum distance e7 between a first developing roller 141 arranged on the downstream side in the rotation direction A of the photoconductor drum 11 and an inner surface portion 140*f* extending to the opening 140*a* of the housing 140 is set to a value larger than a minimum distance e8 between a second developing roller 142 arranged on the upstream side in the rotation direction A of the photoconductor drum 11 relative to the first developing roller 141 and an inner surface portion 140*g* extending to the opening 140*a* of the housing 140 (e7>e8). In addition, in each of the developing devices 14, a minimum distance e8 between the second developing roller 142 and the inner surface portion 140*g* of the housing 140 is set to be equal to or larger than the minimum distance β1 between the gap-reducing member 148 and the first developing roller 141 close to the gap-reducing member 148 and the minimum distance β2 between the gap-reducing member 148 and the second developing roller 142 close to the gap-reducing member 148 (e8≥β1 and β2).

Furthermore, in each of the developing devices 14, as in the developing device 14 in the second exemplary embodiment, at least a minimum distance e7 between (a sleeve 141A of) the first developing roller 141 and the inner surface portion 140*f* of the housing 140 and is set to a value equal to or larger than the minimum distance β1 between the gap-reducing member 148 and the first developing roller 141 close to the gap-reducing member 148 and the minimum distance β2 between the gap-reducing member 148 and the second developing roller 142 close to the gap-reducing member 148 (e7≥β1 and β2). In each of the developing devices 14, at least a minimum distance m7 between the housing 140 and the outer peripheral surface of the photoconductor drum 11 is set to a value equal to or larger than the minimum distance β1 between the gap-reducing member 148 and the first developing roller 141 close to the gap-reducing member 148 and the minimum distance β2 between the gap-reducing member 148 and the second developing roller 142 close to the gap-reducing member 148 (m7≥β1 and β2). In any of these cases, the minimum distances e7 and e8 are set so as to satisfy the relationship e7>e8, as described above.

The developing device 14 is basically operated as in the case of the developing device 14 in the second exemplary embodiment, and develops an electrostatic latent image on the photoconductor drum 11.

Figure 15:
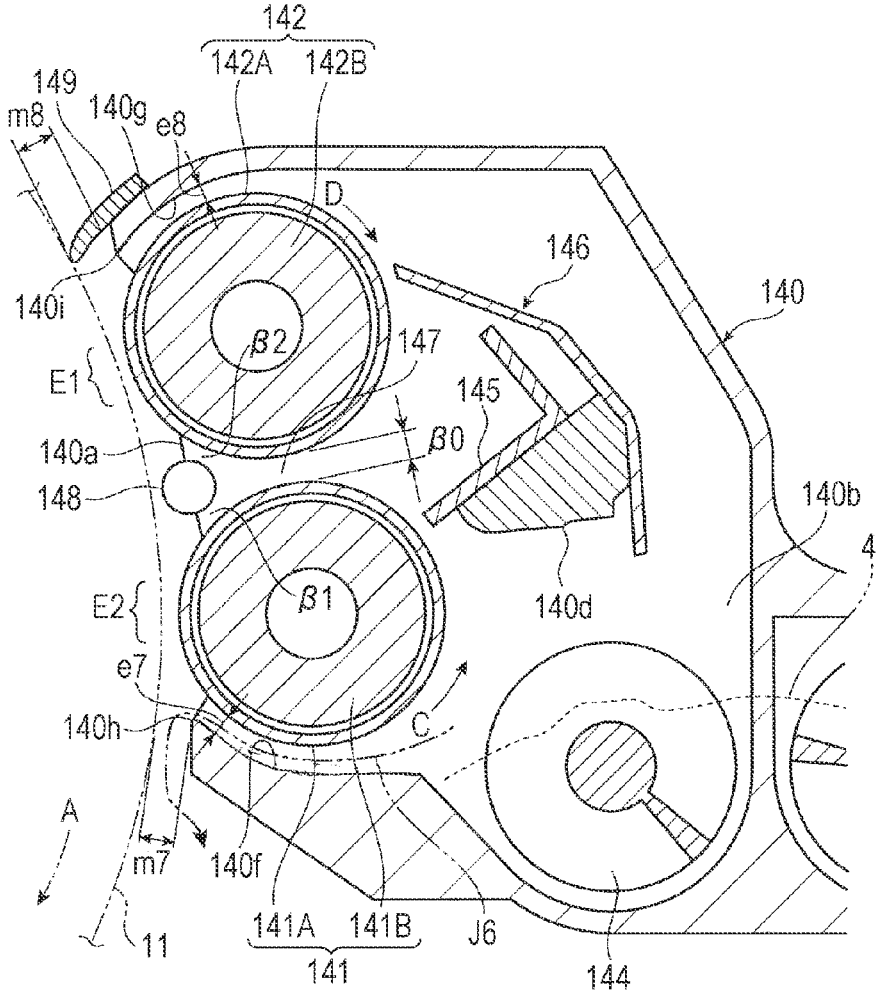
FIG. 15 is an enlarged view illustrating a stopped state after an operation of the developing device illustrated in FIG. 14 is finished.

In the developing device 14, when the operation of image formation by the image forming apparatus 1 is finished and the rotation of the developing rollers 141 and 142 is stopped, compressed or high-pressure air in the housing 140 moves in the direction indicated by the two-dot chain line arrow J6 in FIG. 15. Specifically, the air preferentially passes through the gap (minimum distance e7) between the first developing roller 141 and the inner surface portion 140*f* of the housing 140, which is larger than the gap (minimum distance β1) between the gap-reducing member 148 and the first developing roller 141 and the gap (minimum distance β2) between the gap-reducing member 148 and the second developing roller 142, and moves towards the photoconductor drum 11. Subsequently, the air moves so as to pass through the gap (minimum distance m7) between the housing 140 and the outer peripheral surface of the photoconductor drum 11, which is also larger than the gap (minimum distance β1) between the gap-reducing member 148 and the first developing roller 141 and the gap (minimum distance β2) between the gap-reducing member 148 and the second developing roller 142, and is discharged to the outside of the housing 140.

As a result, in this developing device 14, it is possible to significantly suppress a phenomenon in which compressed or high-pressure air in the housing 140 flows into and stays in the substantially triangular cross section space formed between the two developing rollers 141 and 142 and the photoconductor drum 11. Accordingly, in this developing device 14, it is also possible to further suppress a change in the sensitivity of the photoconductor drum 11 (photosensitive layer) due to the adsorption of a water component remaining in the toner of the developer 4 onto an unreacted hydroxyl group in the protective layer 116, which is the top surface layer of the photoconductor drum 11. Therefore, in the image forming apparatus 1 including this developing device 14, even when image formation is restarted after the image forming apparatus 1 is left standing for a long period, it is possible to suppress the generation of the regions (NG) where the image density is decreased in strip shapes on an image output at that time.

Since this developing device 14 includes the gap-reducing member 148, the additional advantage achieved in the developing device 14 in the second exemplary embodiment is also obtained.

In addition, since this developing device 14 includes the leak-preventing member 149, it is possible to reliably prevent the developer (toner) 4 in the housing 140 from leaking through a gap (minimum distance m8) between the photoconductor drum 11 and a closest position (edge 140*i*) of the housing 140, the position being located on the upstream side in the rotation direction A of the photoconductor drum 11, during operation of image formation and at the time of stopping of the operation.

Furthermore, since the leak-preventing member 149 is provided, the minimum distance e8 between the second developing roller 142 and the inner surface portion 140*g* of the housing 140, the inner surface portion 140*g* being located on the upstream side in the rotation direction A of the photoconductor drum 11, is smaller than the minimum distance e7 between the first developing roller 141 and the inner surface portion 140*f* of the housing 140, the inner surface portion 140*f* being located on the downstream side in the rotation direction A of the photoconductor drum 11. Accordingly, the minimum distance e8 between the second developing roller 142 and the inner surface portion 140*g* of the housing 140 is made smaller than the minimum distance e4 in the developing device 14 of the second exemplary embodiment. Specifically, the housing 140 has a shape in which the gap between the second developing roller 142 and the inner surface portion 140*g* extending to the opening 140*a* of the housing 140 is narrower than that in the developing device 14 of the second exemplary embodiment. Thus, in this developing device 14, at the time of stopping of the image forming operation, it is also possible to more reliably prevent air in a compressed state or the like from passing through the gap (minimum distance e8) between the second developing roller 142 and the inner surface portion 140*g* of the housing 140.

Other Exemplary Embodiments

In the first and second exemplary embodiments, a description has been made of an example in which two minimum distances e (for example, e1 and e2) between the inner surface portion extending to the opening 140*a* of the housing 140 and the developing roller 141 and between the inner surface portion extending to the opening 140*a* of the housing 140 and the developing roller 142 in the developing device 14 are set to be the same value. Alternatively, the two minimum distances e may be set to be different values as long as a precondition regarding magnitude correlation is satisfied. In the first and second exemplary embodiments, a description has been made of an example in which minimum distances m (for example, m1 and m2) between the housing 140 and the photoconductor drum 11 in the developing device 14 are set to be the same value. Alternatively, the two minimum distances m may be set to be different values as long as a precondition regarding magnitude correlation is satisfied. Furthermore, in the second and fourth exemplary embodiments, a description has been made of an example in which the minimum distance β1 between the gap-reducing member 148 and the first developing roller 141 and the minimum distance β2 between the gap-reducing member 148 and the second developing roller 142 are set to be the same value. Alternatively, the two minimum distances β1 and β2 may be set to be different values as long as a precondition regarding magnitude correlation (a condition that each of the minimum distances β1 and β2 is smaller than the minimum distance β0 between the developing rollers) is satisfied.

In the first to fourth embodiments, a description has been made of an example of a developing device 14 including two developing rollers 141 and 142. However, the number of developing rollers is not limited to two, and may be three or more.

In the case where a developing device including three or more developing rollers is used, the term "minimum distance between the plural developing rollers" refers to plural minimum distances among the three or more developing rollers. In such a case, the gap-reducing member 148 may be arranged at all the plural positions among the three or more developing rollers. Alternatively, the gap-reducing member 148 may be arranged at only some of the plural positions. In such a case, regarding a minimum distance e between an inner surface portion of the housing 140 and a developing roller, among the three or more developing rollers, the most upstream developing roller arranged on the most upstream side and the most downstream developing roller arranged on the most downstream side with respect to the rotation direction A of the photoconductor drum 11 relate to the minimum distance e.

The number of imaging devices 10 in the image forming apparatus 1 is not limited to 6. The number of imaging devices 10 may be another plural number (2 to 5, or 7 or more) or may be one. In the imaging device 10, instead of a drum-shaped photoconductor such as the photoconductor drum 11, other forms of photoconductor such as a belt-shaped photoconductor may be used.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a rotatable photoconductor including a top surface layer having a cross-linked structure formed by dehydration condensation of a charge-transporting monomer having a hydroxyl group; and a developing device that uses a developer that exhibits magnetism, the developer containing a toner obtained by dispersing fine particles that form the toner in a solvent containing water, causing aggregation, and conducting heating, the developing device including a housing having an opening for development at a position facing the photoconductor, and a plurality of developing rollers that are exposed through the opening in the housing, that rotate without contacting a surface of the photoconductor, and that are arranged without contacting each other in a direction in which the surface of the photoconductor rotates, wherein a minimum distance between an inner surface portion extending to the opening of the housing of the developing device and one of the developing rollers arranged close to the inner surface portion and a minimum distance between the housing and the surface of the photoconductor are each equal to or larger than a minimum distance between the developing rollers, and wherein a minimum distance between each of the developing rollers and the photoconductor is less than the minimum distance between the developing rollers.

2. The image forming apparatus according to claim 1, wherein the developing device further includes a leak-preventing member that contacts the surface of the photoconductor to prevent the developer from leaking to the outside of the housing, the leak-preventing member being arranged at a position of the housing on the most upstream side in a rotation direction of the photoconductor, a minimum distance between, among the developing rollers, a most downstream developing roller arranged on the most downstream side in the rotation direction of the photoconductor and the inner surface portion of the housing is larger than a minimum distance between, among the developing rollers, a most upstream developing roller arranged on the most upstream side in the rotation direction of the photoconductor and the inner surface portion of the housing, and the minimum distance between the most upstream developing roller and the inner surface portion of the housing is equal to or smaller than the minimum distance between the developing rollers.

3. The image forming apparatus according to claim 1, wherein the top surface layer of the photoconductor contains water-repellent fine particles.

* * * * *